US005663115A

United States Patent [19]

Naito et al.

[11] Patent Number: 5,663,115

[45] Date of Patent: Sep. 2, 1997

[54] THERMAL RECORDING MEDIUM AND RECORDING METHOD

[75] Inventors: Katsuyuki Naito; Masami Sugiuchi, both of Yokohama; Satoshi Takayama; Hirohisa Miyamoto, both of Kawasaki; Hideyuki Nishizawa; Sawako Fujioka, both of Tokyo; Akiko Watanabe, Kawasaki; Tatsuo Nomaki, Fujisawa, all of Japan

[73] Assignee: Kabushiki Kaisha Toshiba, Kawasaki, Japan

[21] Appl. No.: 395,930

[22] Filed: Feb. 28, 1995

[30] Foreign Application Priority Data

| | | | |
|---|---|---|---|
| Mar. 1, 1994 | [JP] | Japan | 6-031046 |
| Oct. 31, 1994 | [JP] | Japan | 6-266394 |
| Nov. 22, 1994 | [JP] | Japan | 6-287602 |

[51] Int. Cl.[6] ..... B41M 5/34

[52] U.S. Cl. ..... 503/201; 503/209

[58] Field of Search ..... 427/150–152; 503/201, 208, 209, 216–218, 225

[56] References Cited

U.S. PATENT DOCUMENTS

| | | | |
|---|---|---|---|
| 4,375,492 | 3/1983 | Fox | 428/212 |

FOREIGN PATENT DOCUMENTS

| | | | |
|---|---|---|---|
| 0576015 | 12/1993 | European Pat. Off. . | |
| 4221322 | 1/1994 | Germany . | |
| 59-186152 | 10/1984 | Japan | 503/217 |
| 62-101684 | 5/1987 | Japan | 503/217 |

*Primary Examiner*—Bruce H. Hess

*Attorney, Agent, or Firm*—Oblon, Spivak, McClelland, Maier & Neustadt, P.C.

[57] ABSTRACT

A thermal recording medium comprising a color former, a developer and a reversible material which can effect a reversible change in at lease a part of a composition system where thermal energies with two different values are supplied or where two different heat histories are provided, and a phase separation controller serves to change phase separation rate between the color former or the developer and the reversible material in the vicinity of its melting point, if necessary.

27 Claims, 8 Drawing Sheets

THERMAL RECORDING MEDIUM AND RECORDING METHOD

BACKGROUND OF THE INVENTION

1. Field of the Invention

The present invention relates to a reversible thermal recording medium and a recording method using this recording medium.

2. Description of the Related Art

Recently, with the advance of office automation the amount of various information has significantly increased, and chances of information output have also increased with increasing information amount. Generally, information outputs are classified into a hard copy output from a printer to paper and a display output. Unfortunately, in the hard copy output a large quantity of paper is consumed as a recording medium if the information output amount increases. Therefore, the hard copy output is expected to be a problem in the future in respect of natural resource protection. On the other hand, the display output requires a large-scale circuit board in a display unit. This brings about problems of portability and cost. For these reasons, a rewritable recording medium capable of reversibly recording and erasing display images, which is free from the above conventional problems, is anticipated as a third recording medium.

Conventionally, as a recording material of such a rewritable recording medium, a composition containing a color former, e.g., a leuco dye, and a developer, e.g., an acid, has been extensively studied. This composition develops or loses a color in accordance with the interaction between the color former and the developer. For example, as a recording medium capable of chemically repeating coloring and decoloring when supplied with thermal energy, Jpn. Pat. Appln. KOKAI Publication No. 4-50,290 has proposed a composition consisting of a leuco dye, an acid as a developer, and a long-chain amine as a decolorizing agent. Also, it is reported in the 42nd Polymer Forum Preprints, 1993, page 2,736, and Jpn. Pat. Appln. KOKAI Publication Nos. 4-247,985, 4-308,790 and 4-344,287 that in a composition prepared by mixing a leuco dye and long-chain alkyl phosphonic acid, coloring and decoloring occur reversibly when the crystal forms are altered under control using thermal energy. Another conventional recording material is described in Japan Hardcopy '93, pp. 413 to 416. This recording material makes use of the fact that in a composition system consisting of a leuco dye which is highly amorphous and a long-chain 4-hydroxyanilide compound which is highly crystallizable, reversible coloring and decoloring based on a crystalline-to-amorphous transition of the entire composition system take place under control using thermal energy.

These recording materials, however, are generally unsatisfactory in colorlessness in the decolored state, so the contrast ratio between the colored and decolored states obtained by these materials is not so high. In particular, these recording materials have the tendency that the background display is hard to provide because it is difficult to obtain a colorless, transparent state. In the composition system as discussed above in which the long-chain 4-hydroxyanilide compound is blended as a developer, the contrast ratio is relatively high, but a large thermal energy is required in melting the crystal in the crystalline-to-amorphous transition of the composition system. This is a disadvantage in respect of energy savings. Another example of the material which changes the colored state in the crystalline-to-amorphous transition is an Ni complex disclosed in Mol. Cryst. Liquid Cryst. 1993, 235, p. 147. This material develops green color in the crystalline state and red color in the amorphous state and is neither colorless nor white in either of the crystalline or amorphous state. Therefore, by using this material it is difficult to realize a display with a high contrast ratio.

As discussed above, many attempts have been conventionally made to use a composition system containing a color former and a developer, as the recording material for a rewritable recording medium. Unfortunately, none of these composition systems has been put into practical use due to problems of, e.g., low contrast ratio between the colored and decolored states and energy savings.

In addition, as rewritable recording media capable of recording and erasing by using a thermal printer head (TPH), composition systems comprising an organic low molecular weight compound and a high molecular weight resin matrix are disclosed, for example, in Jpn. Pat. Appln. KOKAI Publication Nos. 55-154,198 and 57-82,086, which have been employed in some prepaid cards. The composition systems, however, have disadvantages that their operable temperature range is very narrow, in which recording and erasing can be performed in a short time by using TPH, and that their repeatable times between recording and erasing are limited to about 150 to 500 times. Consequently, the application fields of the rewritable recording media are greatly restricted. Therefore, it is difficult to apply them to a card for station service where the operating temperature range is very wide. Moreover, the composition systems have a disadvantage that they are poor in visibility due to a reversible change between a cloudy state and a transparent state.

SUMMARY OF THE INVENTION

It is an object of the present invention to provide a rewritable recording medium having a high contrast ratio between the colored and decolored states and capable of using a background display. It is an other object of the present invention to provide a rewritable recording medium capable of saving energy in recording and erasing. It is an another object of the present invention to provide a rewritable recording medium capable of recording and erasing at a higher rate. It is still another object of the present invention to provide an information recording and erasing method using these recording media.

A thermal recording medium of the present invention contains a color former and a developer whose glass transition temperature is 25° C. or higher. In this recording medium, information recording and erasing are performed on the basis of a reversible crystalline-to-amorphous transition.

Another thermal recording medium of the present invention contains a color former, a developer, and a matrix material. In this recording medium, information recording and erasing are performed on the basis of a reversible crystalline-to-amorphous transition.

Still another thermal recording medium of the present invention contains a color former, a developer, and a reversible material.

Still another thermal recording medium of the present invention contains a color former, a developer, a reversible material, and a phase separation controller.

In a recording method using the thermal recording medium of the present invention, thermal energies with two different values are supplied to heat the recording medium up to a temperature equal to or higher than a crystallization temperature Tc and lower than a melting point Tm and to a temperature equal to Or higher than the melting point Tm, thereby performing information recording and erasing.

DETAILED DESCRIPTION OF THE PREFERRED EMBODIMENTS

Figure 1:
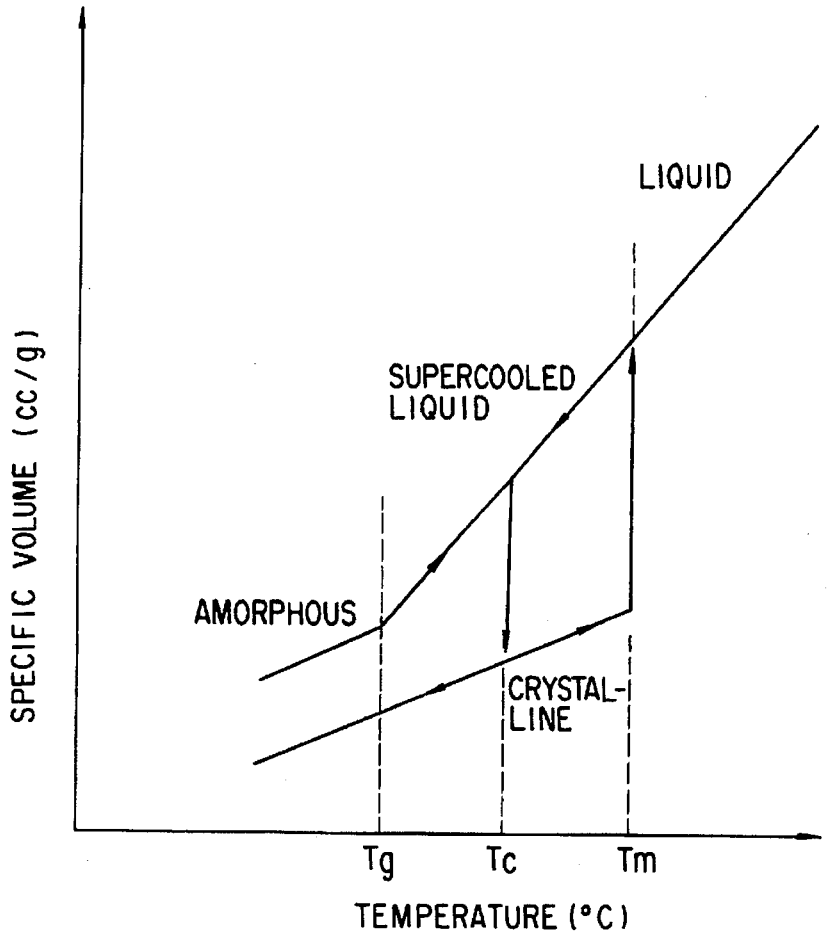
FIG. 1 is a graph showing the thermal characteristics of the thermal recording medium of the present invention.

First, the functions of the basic components constituting the recording medium of the present invention and the operation principle of the recording medium will be briefly described below.

In a general sense, a color former is a precursor compound of a coloring matter which forms a display image, and a developer is a compound which changes the colored state of the color former by using the interaction (primarily exchange of electrons) between the developer and the color former. That is, the combination of a color former and a developer generally means a combination of two types of compounds which develop a color when the interaction between them increases and lose a color when the interaction decreases. In the present invention, the terms "color former" and "developer" should be interpreted in a broad sense, although the above restricted meanings are naturally included. That is, the present invention includes a combination of two types of compounds (in a narrow sense, a coloring matter and a decolorizing agent) which are deprived of a color when the interaction between them increases and develop a color when the interaction decreases. For simplicity in explanation, however, the present invention will be discussed centering on the combination of a color former and a developer in the former narrow sense. The combination of a coloring matter and a decolorizing agent in the latter broad sense will be discussed on occasion as a supplementary explanation.

In the present invention, a matrix material has at least a function of decreasing the concentrations of the color former and the developer. The matrix material can be either a low-molecular or polymer compound so long as the compound has this function. A composition system as an object of the present invention causes a reversible change between two states different either crystallographically or thermodynamically. The matrix material can have an effect on this reversible change. That is, in the present invention the matrix material may be a compound having a function, when it is blended together with the composition system consisting of the color former and the developer, that imparts to the three-component system a property to easily cause aforementioned reversible change, even in a case where the two-component system of the color former and the developer is hard to cause the reversible change. Note that in the present invention, a matrix material having the latter function is termed a reversible material. A matrix material as the reversible material can further have a property of interacting with the color former and/or the developer. For example, a significant difference may be produced due to an interaction of a certain kind between the solubility of the reversible material with respect to one of the color former and the developer and the solubility with respect to the other, and this may consequently influence the interaction between the color former and the developer, which causes coloring and decoloring.

The reversible change between the two states different either crystallographically or thermodynamically will be described below. A composition system as an object of the present invention brings about a reversible change between a crystalline state and an amorphous state (crystalline-to-amorphous transition), or a reversible change between two phase separation states or between a phase separation state and a non-phase separation state.

For the crystalline-to-amorphous transition, the crystalline state is an equilibrium state, and the amorphous state is a metastable nonequilibrium state. The composition system of the present invention has a sufficiently long life at room temperature even in the amorphous state. A slight potential barrier exists between the crystalline and amorphous states. For the phase separation state and the non-phase separation state, on the other hand, the phase separation state is a stable equilibrium state, and the non-phase separation state is a relatively unstable nonequilibrium state. The composition system of the present invention, however, has a sufficiently long life at room temperature even in the non-phase separation state. No potential barrier exists between the phase separation state and the non-phase separation state. The latter reversible change may be any change occurs between crystalline and amorphous between crystalline and crystalline, or between amorphous and amorphous. In the latter reversible change, the process of the change from one phase separated state to the other phase separated state or from the non-phase separation state to the phase separation state is a phenomenon known as a spinodal decomposition or a micro phase separation. Which of these reversible changes takes place is not determined only by the combination of the substances used. For example, either of the crystalline-to-amorphous transition or the reversible change between the phase separation state and the non-phase separation state can occur for the same combination of substances if the mixing ratio of these substances changes.

The crystalline-to-amorphous transition in the composition system of the present invention will be described below with reference to FIG. 1. The composition system as an object of the present invention forms a metastable amorphous substance with a long life at room temperature. When the composition system in the amorphous state is crystallized by heating up to a temperature equal to or higher than a crystallization temperature Tc and lower than a melting point Tm and cooling, the crystal is kept stable at room temperature. When the composition system in the crystalline state is heated to a temperature equal to or higher than the melting point Tm and the resultant molten liquid is quenched or annealed to room temperature lower than a glass transition temperature Tg, the composition system returns to the amorphous state. Therefore, in the composition system having the thermal characteristics as in FIG. 1, crystalline-to-amorphous transitions can be reversibly repeated by supplying thermal energies with two different values capable of heating the composition system up to a temperature equal to or higher than the crystallization temperature Tc and lower than the melting point Tm and to a temperature equal to or higher than the melting point Tm. Also, crystalline-to-amorphous transitions can be reversibly repeated by providing to the composition system two heat histories different in cooling rate after heating of the composition system up to a temperature equal to or higher than the melting point Tm. More specifically, the composition system may turn to a crystalline state when the melt produced by heating is gradually annealed to the room temperature, while it may turn to an amorphous state when the melt is rapidly quenched to the room temperature.

One aspect of the present invention is a thermal recording medium which contains a color former and a developer whose glass transition temperature is 25° C. or higher, and in which information recording and erasing are performed on the basis of a reversible crystalline-to-amorphous transition. The crystalline-to-amorphous transition in this two-component system of the color former and the developer will be described below. Normally, in the crystalline state the color former and the developer are phase-separated with each other and the interaction between them decreases. In the amorphous state, on the other hand, the color former and the developer mix together and the interaction between them increases. Therefore, in the crystalline state the combination of a color former and a developer in the narrow sense is in a decolored state, i.e., is colorless or white resulting from light scattering. In the amorphous state, the combination develops a color, i.e., is colored in a transparent state.

Another aspect of the present invention is a thermal recording medium which contains a color former, a developer, and a matrix material (reversible material), and in which information recording and erasing are performed on the basis of a reversible crystalline-to-amorphous transition. That is, the concentrations of the color former and the developer in the composition system are decreased by adding the matrix material, thereby increasing the contrast ratio between the color and decolored states. The case in which a crystalline-to-amorphous transition occurs in this three-component system of a color former, a developer, and a reversible material will be described below. As mentioned earlier, the reversible material has an effect on the reversible crystalline-to-amorphous transition takes place in the composition system of an object of the present invention. Usually, in the crystalline state the color former and the developer segregate in the grain boundary of the reversible material that is crystallized, increasing the interaction between them. On the other hand, in the amorphous state the color former and the developer evenly mix in the reversible material to decrease the interaction. In the amorphous state, if the interaction of the reversible material with respect to one of the color former and the developer is large (e.g., if the solubility of the reversible material with respect to one of the color former and the developer is relatively high), the interaction between the color former and the developer decreases significantly. Consequently, this composition system is colored in the crystalline state and decolored in the amorphous state. Note that in some instances one of the color former and the developer forms a mixed crystal together with the reversible material and is thereby nearly completely separated from the other. In this case, the interaction between the color former and the developer is significantly decreased with the result that the composition system is decolored.

As discussed above, the recording/erasing mode in a two-component system containing a color former and a developer is in many cases the reverse of that in a three-component system containing a color former, a developer, and a reversible material.

In the recording medium of the present invention, crystalline-to-amorphous transitions can be repeated in either the entire composition system or in a portion of the system during recording and erasing. Also, if a plurality of components in the composition system form crystalline substances, these components can separately form their respective crystal substances or integrally form one crystal substance. In addition, in the present invention it is possible to use a combination of a color former and a developer (a coloring matter and a decolorizer in a narrow sense) which are deprived of a color when the interaction between them increases and develop a color when the interaction decreases.

Whether the composition system is a crystalline substance or an amorphous substance can be analyzed by properly combining general methods such as X-ray diffraction or electron diffraction and light transmittance measurement. For example, in the X-ray diffraction or the electron diffraction, sharp peaks or spots are observed if the system is a crystalline substance, and no such sharp peaks or spots are observed if the system is an amorphous substance. On the other hand, the light transmittance measurement can evaluate light scattering in the system. That is, if the system is a polycrystalline substance, light having a short wavelength is scattered more strongly, and consequently the light transmittance decreases as the wavelength shortens. Therefore, this reduction in the light transmittance can be distinguished, by observing the wavelength dependence of the light transmittance, from a reduction in the light transmittance caused by absorption. The grain size of the crystal also can be estimated. Furthermore, it is possible by performing these measurements to detect whether the entire composition system or a portion of the system repeats crystalline-to-amorphous transitions during recording and erasing of the recording medium of the present invention. The pattern of peaks and spots obtained by the X-ray diffraction or the electron diffraction is inherent in each component of the composition system. Therefore, by analyzing the obtained pattern it is possible to specify the component which repeats crystalline-to-amorphous transitions in the composition system.

Figure 2:
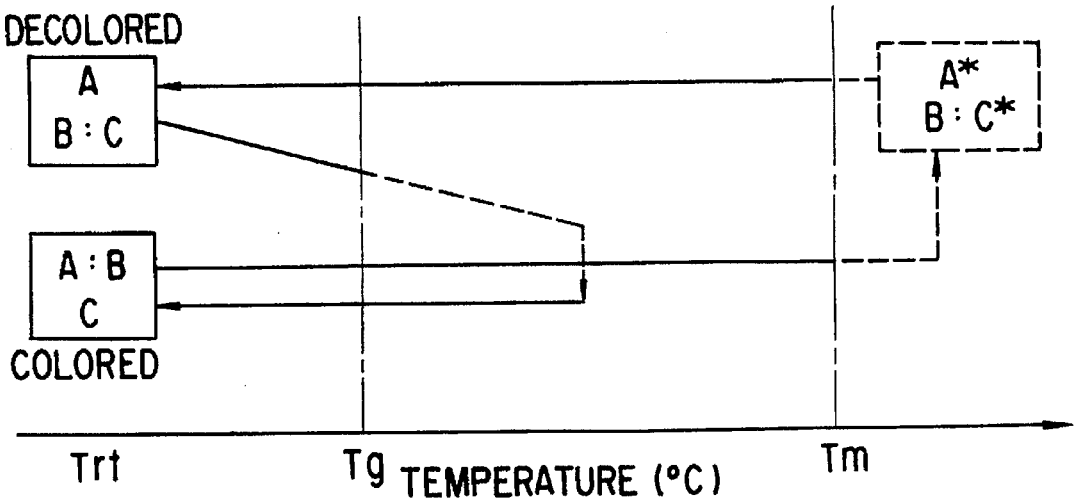
FIG. 2 is a view showing changes in the state of the thermal recording medium of the present invention which contains three components, a color former, a developer, and a reversible material.
Figure 3:
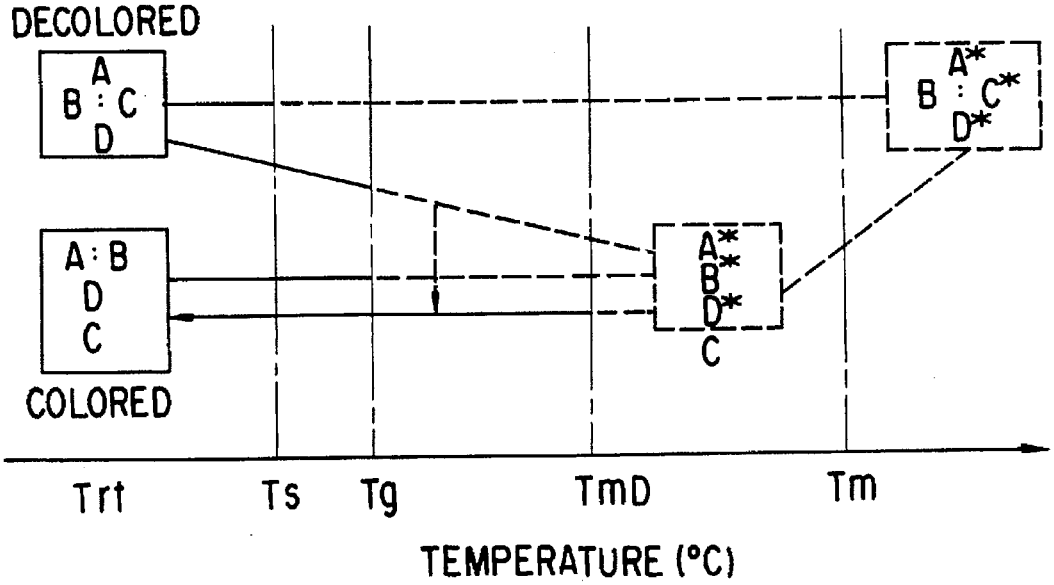
FIG. 3 is a view showing changes in the state of the thermal recording medium of the present invention which contains four components, a color former, a developer, a reversible material, and a phase separation controller.

The reversible change between the phase separation state and the non-phase separation state will be described next. FIG. 2 illustrates an example of a typical coloring/decoloring mechanism in a three-component system consisting of a color former, a developer, and a reversible material. In FIG. 2, reference symbols A, B, and C denote the color former, the developer, and the reversible material, respectively. FIG. 2 shows the case in which the interaction between the reversible material C and the developer B is great (more specifically, the solubility of the developer B with respect to the reversible material C is high during melting). Also, the symbol ":" represents the interaction, and the symbol "*" represents to be flowable state.

At room temperature (Trt), the colored state in which the phase of the color former A and the developer B is separated from the phase of the reversible material C is close to an equilibrium in respect of the solubilities. When the composition system is heated from this state to the melting point (Tm) or higher, the developer B ceases to interact with the color former A and simultaneously starts to interact with the reversible material C in a flowable state. As a result, at the melting point or higher temperatures the system loses its color. When the system is forced to be fixed by quenching from this molten state, the reversible material C that has interacted with the developer B forms an amorphous substance as it incorporates the developer B in excess of the equilibrium solubility. Consequently, the system becomes colorless at room temperature. This amorphous substance in the nonequilibrium state has an extremely long life at temperatures below the glass transition point (Tg). If the room temperature is below Tg, therefore, this nonequilibrium state does not easily transit to an equilibrium state.

When the amorphous substance in the nonequilibrium state is heated to a temperature higher than the glass transition point, the diffusion rate of the developer B in the system increases abruptly. Consequently, the phase separation between the developer B and the reversible material C is accelerated in the direction in which the nonequilibrium state returns to the original equilibrium state. At a temperature (Tc') at which color development by the phase separation is readily achievable within a predetermined time, the reversible material C which is phase-separated from the developer B crystallizes rapidly. Therefore, the crystallization temperature (Tc) can be considered as the lower limit value of the color development temperature. After an elapse of a predetermined time at the crystallization temperature or higher and the melting point or lower, the composition system is in a stabler phase separation state closer to an equilibrium state, i.e., in a colored state. Therefore, equilibrium-to-nonequilibrium phase changes can be reversibly repeated by properly supplying thermal energies with two different values capable of heating the reversible material up to a temperature equal to or higher than the crystallization temperature Tc and lower than the melting point Tm and to a temperature equal to or higher than the melting point Tm. This makes it possible to repetitively obtain the colored and decolored states. Strictly speaking, the colored state depends upon the equilibrium solubility or the state of the developer. Therefore, it is necessary to take into account the fact that the coloring density of the system is under the influence of the heating temperature and the heating time.

Figure 4:
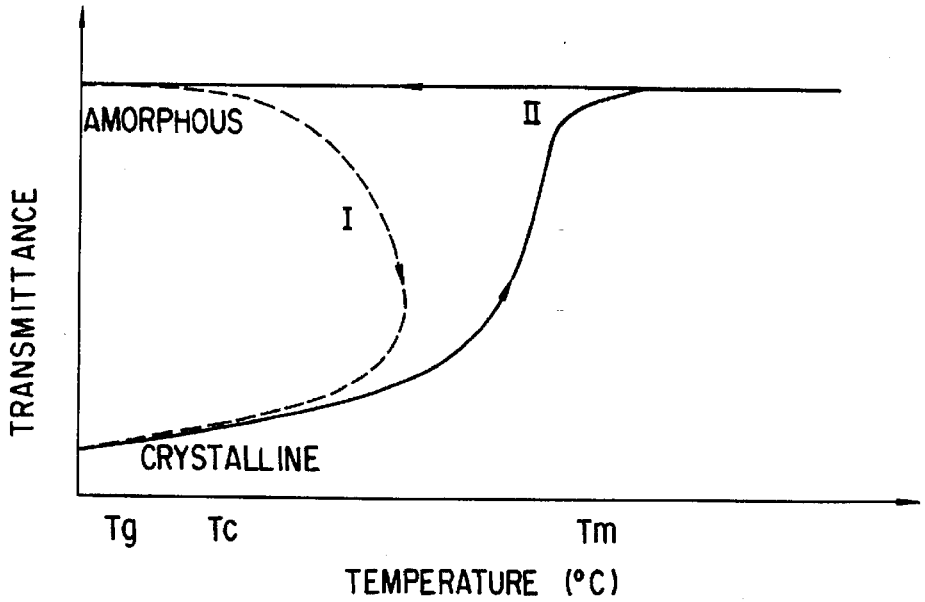
FIG. 4 is a graph showing the relationship between the temperature and the transmittance in the thermal recording medium of the present invention.

Generally, however, the coloring (recording) rate and the stability of the colored and decolored states are conflicting properties. It is in many instances difficult to improve these two characteristics in a three-component system of a color former, a developer, and a reversible material. To solve this problem, the present inventors have developed, as another aspect of the invention, a recording medium of a four-component system in which a phase separation controller is blended together with a color former, a developer, and a reversible material. The phase separation controller used in the present invention is a compound having a function of encouraging a phase separation in the neighborhood of its melting point during the process of the change from the non-phase separation state to the phase separation state. The melting point of this phase separation controller is lower than the melting point of a three-component system consisting of a color former, a developer, and a reversible material. FIG. 4 shows an example of a typical coloring/decoloring mechanism of a four-component system of a color former, a developer, a reversible material, and a phase separation controller. In FIG. 4, the symbol D denotes the phase separation controller.

At room temperature Trt, the colored state in which the phase of the color former A and the developer B, the phase of reversible material C, and the phase of the phase separation controller D are separated is close to an equilibrium in respect of the solubilities. When the composition system is heated from this state to a melting point Tm or higher of the composition system, the developer B ceases to interact with the color former A and simultaneously starts to interact with the reversible material C in a flowable state. As a result, at the melting point or higher temperatures the system loses its color. When the four-component system is cooled from the molten state, a miscible mixture of the reversible material C and the phase separation controller D forms a supercooled liquid which maintains the flowability even at temperatures lower than the melting point. Consequently, the developer B and the reversible material C in a flowable state solidify at low temperatures below the glass transition point Tg while maintaining an interaction between them. The reversible material C forms an amorphous substance as it incorporates the developer B in excess of the equilibrium solubility, resulting in a colorless nonequilibrium state. Therefore, in the four-component system it is possible to obtain a colorless nonequilibrium state by either quenching or annealing. Even an amorphous substance in a nonequilibrium state of the four-component system has a long life at temperatures below the glass transition point (Tg). If the room temperature is below Tg, therefore, this nonequilibrium state does not easily transit to an equilibrium state.

When the amorphous substance in the nonequilibrium state of the four-component system is heated to a temperature higher than the glass transition point, the diffusion rate of the developer B in the system increases abruptly. Consequently, the phase separation between the developer B and the reversible material C is accelerated in the direction in which the nonequilibrium state returns to the original equilibrium state. When the temperature exceeds the melting point (TmD) of the phase separation controller D, the liquefied phase separation controller D dissolves the developer B and a portion of the reversible material C. This dramatically increases the diffusion rate of the developer B and accelerates the phase separation between the developer B and the reversible material C. When the temperature of the system is again decreased from this state to the solidification point of the phase separation controller D or lower, the solubility of the developer B to the phase separation controller D abruptly decreases upon solidification. This instantaneously separates the phases of the developer B and the phase separation controller D. The developer B thus phase-separated again interacts with the color former A, and the system is set in a stabler colored state closer to an equilibrium state. The coloring rate of the composition system containing the phase separation controller D brings about a two to four orders of magnitude change in exceeding the glass transition point, and again causes a three to four orders of magnitude change in exceeding the melting point. In the four-component system of this example, therefore, equilibrium-to-nonequilibrium phase changes can be reversibly repeated at an extremely high rate by properly supplying thermal energies with two different values capable of heating up to the melting point (Tm) of the system and the melting point (TmD) of the phase separation controller. This makes it possible to repetitively obtain colored and decolored states regardless of whether the thermal history is quenching or annealing.

The present invention will be described in more detail below.

First, a recording medium of the present invention which consists of a two-component system of a color former and a developer whose glass transition temperature is 25° C. or more, will be described.

Examples of the color former for use in the present invention are electron-donating organic substances, such as leucoauramines, diarylphthalides, polyarylcarbinols, acylauramines, arylauramines, Rhodamine B lactams, indolines, spiropyrans, fluorans, cyanine dyes, and Crystal Violet, and electron-accepting organic substances, such as phenolphthaleins.

More specifically, examples of the electron-donating organic substance are Crystal Violet lactone, Malachite Green lactone, Crystal Violet carbinol, Malachite Green carbinol, N-(2,3-dichlorophenyl)leucoauramine, N-benzoylauramine, Rhodamine B lactam, N-acetylauramine, N-phenylauramine, 2-(phenyliminoethanedilidene)-3,3-dimethylindoline, N-3,3-trimethylindolinobenzospiropyran, 8'-methoxy-N-3,3-trimethylindolinobenzospiropyran, 3-diethylamino-6-methyl-7-chlorofluoran, 3-diethylamino-7-methoxyfluoran, 3-diethylamino-6-benzyloxyfluoran, 1,2-benzo-6-diethylaminofluoran, 3,6-di-p-toluidino-4,5-dimethylfluoran-phenylhydrazido-γ-lactam, and 3-amino-5-methylfluoran.

Examples of the electron-accepting organic substance are phenolphthalein, tetrabromophenolphthalein, phenolphthaleinethylester, and tetrabromophenolphthaleinethylester.

These compounds can be used singly or in the form of a mixture of two or more types of them. In the present invention, a color display can be obtained since colored states in various colors can be attained by properly choosing the color formers. Of the above compounds, cyanine dyes and Crystal Violet sometimes lose a color when the interaction with the developer increases and develop a color when the interaction decreases.

When an electron-donating organic substance is used as the color former, examples of the developer are acidic compounds such as phenols, phenol metal salts, carboxylic acid metal salts, sulfonic acids, sulfonates, phosphoric acids, phosphoric acid metal salts, acidic phosphoric ester, acidic phosphoric ester metal salts, phosphites, and phosphorous acid metal salts. When an electron-accepting organic substance is used as the color former, on the other hand, examples of the developer are basic compounds such as amines. These compounds can be used singly or in the form of a mixture of two or more types of them.

In the recording medium of the present invention which contains a color former and a developer whose glass transition temperature is 25° C. or higher, the glass transition temperature of the developer is defined to be 25° C. or higher because, as explained below, this reduces the amount of thermal energy to be supplied in recording and erasing, thereby making energy savings possible.

Generally, for a component which has a distinct glass transition temperature Tg at room temperature or higher and readily forms an amorphous substance, an empirical rule of $Tg=a \cdot Tm$ (a is 0.65 to 0.8, and Tg and Tm are absolute temperatures) is established between the glass transition temperature Tg and the melting point Tm; that is, the melting point Tm rises as the glass transition temperature Tg rises. In this case if the glass transition temperature Tg of the developer is 25° C. or higher, the melting point Tm is expected to be about 100° to 200° C. In the present invention, recording or erasing is performed by heating the recording material up to a temperature higher than the melting point Tm. Therefore, if the melting point Tm is high, it is expected that the amount of thermal energy supplied before the recording material melts is increased. The present inventors have made extensive studies on the relationship between the glass transition temperature Tg of the developer and the amount of thermal energy required in recording and erasing. As a result, the present inventors have acquired a surprising knowledge that the use of a developer whose glass transition temperature Tg is 25° C. or higher decreases, rather than increases, the amount of thermal energy to be supplied before the recording material melts, in comparison with the case in which a developer which has a glass transition temperature Tg lower than room temperature and hence is highly crystalline is blended.

That is, the present inventors have focused attention on a maximum crystal growth velocity MCV as a parameter indicative of the degree of the amorphous nature of a component which easily forms an amorphous substance as discussed above. Consequently, the present inventors have found that the relationship represented by Equation (1) below is established between the maximum crystal growth velocity MCV, a melting enthalpy change ΔH of a crystal per unit weight, a melting point Tm, and a molecular weight Mw (Japanese Patent Application No. 5-40226). Note that in the following equation, $k_0$ is a constant, and $h_c$ is a constant relating to substance group.

$$ln(\mathrm{MCV})=k_0-h_c Mw/(Tm\Delta H) \quad (1)$$

It is clear that the maximum crystal growth velocity MCV is not so high in a developer which has a distinct glass transition temperature Tg of 25° C. or higher and readily forms an amorphous substance. According to Equation (1), a maximum crystal growth velocity MCV which is not so large is equivalent to a small TmΔH. On the other hand, for a component with a high glass transition temperature Tg of 25° C. or higher, the melting point Tm is also relatively high, about 100° to 200° C., as discussed above. When TmΔH is small and Tm is high as described above, the melting enthalpy change ΔH of the crystal is considerably small. In other words, in a component which has a definite glass transition temperature Tg and readily forms an amorphous substance, the melting enthalpy change ΔH decreases as the glass transition temperature Tg increases, and this decreases the amount of thermal energy required to melt the crystal. In contrast, in a component which shows no glass transition and crystallizes even at low temperatures, the maximum crystal growth velocity MCV is high, and the melting enthalpy change ΔH of the crystal is also large.

On the other hand, in the component capable of forming an amorphous substance the melting point Tm tends to rise as the glass transition temperature Tg rises. Therefore, the higher the glass transition temperature Tg, the higher the temperature required in melting. However, a component which has a definite glass transition temperature Tg and readily forms an amorphous substance generally has a small specific heat. Additionally, the amount of thermal energy supplied to raise the temperature to the melting point Tm is directly proportional to the product of the specific heat and the temperature difference between the melting point Tm and room temperature (25° C.). Consequently, even if the glass transition temperature Tg of the developer is high, almost no problems arise since the amount of thermal energy supplied before the recording material reaches the melting point Tm in recording or erasing is not much increased. Therefore, in a recording medium using a developer whose glass transition temperature Tg is 25° C. or higher, a contribution of a small melting enthalpy change AH of the crystal is large. As a consequence, the amount of thermal energy to be supplied before the recording material melts is reduced, and this accomplishes energy savings.

Note that the glass transition temperature Tg is defined to be 25° C. or higher only for a developer for the reason explained below. That is, in a composition system containing a color former and a developer the mixing amount of the developer is generally set large. Therefore, when the developer, rather than the color former, meets the above conditions, the amount of thermal energy to be supplied before the recording material melts can be effectively reduced. Furthermore, in the recording medium of the present invention, the glass transition temperature of the entire composition system is preferably high in respect of thermal stability. To raise the glass transition temperature of the overall composition system, the glass transition temperature Tg of the developer is more preferably 50° C. or higher. However, if the glass transition temperature Tg is too high, a large thermal energy is necessary in crystallizing the system by heating at a temperature equal to or higher than the crystallization temperature Tc and lower than the melting point Tm. Also, the temperature for returning the system to the amorphous state becomes too high to be practical. Therefore, the glass transition temperature Tg is preferably 150° C. or lower.

In a two-component system consisting of a color former and a developer, the mixing ratio of the developer is preferably 0.1 to 100 parts by weight, and more preferably 1 to 10 parts by weight with respect to 1 part by weight of the color former. This is so because, if the mixing ratio of the developer is smaller than 0.1 part by weight, it is difficult to sufficiently increase the interaction between the color former and the developer during recording or erasing. On the other hand, if the mixing ratio of the developer is larger than 100 parts by weight, the color development density in the colored state tends to decrease.

Next, a recording medium according to the present invention which consists of a three-component system containing a color former, a developer and a reversible material, will be described below.

The reversible material used in the present invention is preferably capable of readily forming an amorphous substance with a high colorlessness. The higher the colorlessness and transparency of the amorphous substance, the higher the contrast ratio of a display realized by the resultant recording medium. Also, when a preferable reversible material is selected, a colorless transparent amorphous substance and a colored opaque crystalline substance can be properly formed. In this case, a background display can be utilized. FIG. 4 shows an example of the temperature dependence of the transmittance in a preferable reversible material. As shown in FIG. 4, the transmittance of the reversible material is high in the amorphous state and low in the crystalline state. As indicated by a dashed curve I in FIG. 4, when the composition system in the amorphous state is crystallized by heating up to a temperature equal to or higher than the crystallization temperature Tc and lower than the melting point Tm, this crystalline state is maintained even at room temperature lower than the glass transition point Tg. As indicated by a solid curve II in FIG. 4, the composition system in the crystalline state returns to the amorphous state when the composition system is heated to the melting point Tm or higher and the resultant molten liquid is quenched or annealed to room temperature lower than the glass transition point Tg. Note that the characteristic shown as in FIG. 4 may be obtained in a combination of the reversible material and the color former or in a combination of the reversible material and the developer.

As is apparent from Equation (1), a component with a large molecular weight and a small melting enthalpy change ΔH of a crystal per unit weight is preferable for a reversible material, since the maximum crystal growth velocity MCV is small. Note that when the melting enthalpy change ΔH of the crystal of the reversible material is small, the amount of thermal energy required in melting the crystal is also small. This is desirable in respect of energy savings as well. From these points of view, a compound having a molecular skeleton, such as asteroid skeleton, which is close to a sphere and bulky, is suitably used as the reversible material. More specifically, examples of the compound are cholesterol, stigmasterol, pregnenolone, methylandrostenediol, estradiolbenzoate, epiandrostene, stenolone, β-citosterol, pregnenoloneacetate, and β-cholestarol.

On the other hand, it is difficult to form an amorphous substance by using a low-molecular compound with a molecular weight of less than 100. The formation of an amorphous substance is also difficult by use of a long-straight-chain alkyl derivative or a planar aromatic compound because of a large melting enthalpy change ΔH of the crystal, although the molecular weight of these compounds are 100 or more. However, even if the molecular weight is small or the melting enthalpy change ΔH of the crystal is somewhat large, a polyvalent hydrogen-bonding compound capable of forming a plurality of hydrogen bonds between the molecules readily forms an amorphous substance, since $h_c$ in Equation (1) essentially increases. Practical examples are compounds having a plurality of hydrogen-bonding groups capable of forming hydrogen bonds between the molecules, such as a hydroxyl group, primary and secondary amino groups, primary and secondary amide bonds, an urethane bond group, a urea bond, a hydrazone bond, a hydrazine group, and a carboxyl group. However, a compound which forms hydrogen bonds inside the molecules is not included even if the compound has a plurality of hydrogen-bonding groups inside the molecules.

It is preferable that the reversible material be a compound capable of repeating crystalline-to-amorphous transition by itself, as shown in FIG. 4, by supplying thermal energies with two different values. In order to satisfy this condition, it is important to optimize the molecular structure of the reversible material. In addition, it is effective as well to properly adjust the maximum crystal growth velocity MCV and the maximum crystal growth temperature Tc, max of the entire composition system by using two or more types of reversible materials or by properly selecting a color former or a developer which is used together with the reversible material. In addition, a plurality of reversible materials can be used so as to reversibly repeat between two phase separated states or between a phase separated state and a non-phase separated state by supplying thermal energies with two different values.

Furthermore, it is preferable that the reversible material be a compound capable of interacting with the developer. The reason for this is that, if the reversible material interacts with the developer in the decolored amorphous substance where the color former and the developer exist homogeneously in the reversible material, the interaction between the color former and the developer can be suppressed more effectively. Therefore, a very excellent display in contrast ratio can be realized.

An example of the reversible material may be such a compound that interacts with the developer through an ionic force such as a hydrogen bond. More specifically, examples of the above reversible materials are alcohols, thiols, carboxilic acids, carboxylic esters, phosphates, sulfonic esters, ethers, sulfides, disulfides, sulfoxides, sulfones, and carbonic esters. These compounds can be used singly or in the form of a mixture of two or more types of them.

Preferable mixing ratios in a three-component system consisting of a color former, a developer, and a reversible material are as follows. That is, the mixing ratio of the developer is preferably 0.1 to 10 parts by weight, and more preferably 1 to 2 parts by weight with respect to 1 part by weight of the color former. The reason for this is that if the mixing ratio of the developer is smaller than 0.1 part by weight, it is difficult to sufficiently increase the interaction between the color former and the developer during recording or erasure. If, in contrast, the mixing ratio of the developer is larger than 10 parts by weight, it is difficult to sufficiently decrease the interaction between the color former and the developer during recording or erasure. In either case it may become impossible to realize a display with a high contrast ratio. The mixing ratio of the reversible material is preferably 1 to 200 parts by weight, and more preferably 10 to 100 parts by weight with respect to 1 part by weight of the color former. If the mixing ratio of the reversible material is less than 1 part by weight, crystalline-to-amorphous transitions of the reversible material cannot be utilized. If the mixing ratio of the reversible material exceeds 200 parts by weight, the coloring density in the colored state tends to decrease.

Further, a recording medium according to the present invention which consists of a four-component system containing a color former, a developer, a reversible material and a phase separation controller, will be described.

A suitable example of the phase separation controller for use in the present invention is a highly crystallinable low-molecular organic material having a long-straight-chain portion with 8 or more carbon atoms and polar groups such as OH, CO, and COOH. Practical examples of the material are a straight-chain higher alcohol, a straight-chain higher polyvalent alcohol, a straight-chain higher fatty acid, a straight-chain higher polyvalent fatty acid, esters and ethers of these compounds, a straight-chain higher fatty acid amide, and a straight-chain higher polyvalent fatty acid amide, each having a long-straight-chain alkyl group.

More specifically, examples of the low-molecular organic material are straight-chain higher monovalent alcohols such as stearyl alcohol, 1-eicosanol, 1-docosanol, 1-tetracosanol, 1-hexacosanol, and 1-octacosanol;

straight-chain higher polyvalent alcohols such as 1,8-octanediol, 1,10-decanediol, 1,12-dodecanediol, 1,12-octadecanediol, 1,2-dodecanediol, 1,2-tetradecanediol, and 1,2-hexadecanediol;

straight-chain higher fatty acids such as palmitic acid, stearic acid, 1-octadecanoic acid, behenic acid, 1-docosanoic acid, 1-tetracosanoic acid, 1-hexacosanoic acid, and 1-octacosanoic acid;

straight-chain higher polyvalent fatty acids such as sebacic acid, and 1,12-dodecanedicarboxyl acid;

straight-chain higher ketones such as 14-heptacosanone and stearone;

straight-chain higher fatty acid alcohol amides such as ethanolamide laurate, n-propanolamide laurate, isopropanolamide laurate, butanolamide laurate, hexanolamide laurate, octanolamide laurate, ethanolamide palmitate, n-propanolamide palmirate, isopropanolamide palmitate, butanolamide palmitate, hexanolamide palmitate, octanolamide palmitate, ethanolamide stearate, n-propanolamide stearate, isopropanolamide stearate, butanolamide stearate, hexanolamide stearate, octanolamide stearate, ethanolamide behenate, n-propanolamide behenate, isopropanolamide behenate, butanolamide behenate, hexanolamide behenate, and octanolamide behenate; and straight-chain higher fatty acid diol diesters such as ethyleneglycol dilaurate, propyleneglycol dilaurate, butyleneglycol dilaurate, catechol dilaurate, cyclohexanediol ditaurate, ethyleneglycol dipalmitate, propyleneglycol dipalmitate, butyleneglycol dipalmitate, catechol dipalmitate, cyclohexanediol dipalmitate, ethyleneglycol distearate, propyleneglycol distearate, butyleneglycol distearate, catechol distearate, cyclohexanediol distearate, ethyleneglycol dibehenate, propyleneglycol dibehenate, butyleneglycol dibehenate, catechol dibehenate, and cyclohexanediol dibehenate.

These compounds can be used singly or in the form of a mixture of two or more types of them. The mixture usable as the material of the phase separation controller can be chosen from ester-based wax, alcohol-based wax, and urethane-based wax.

In a four-component system consisting of a color former, a developer, a reversible material, and a phase separation controller, a preferable mixing ratio of the developer to the color former and a preferable mixing ratio of the reversible material to the color former are identical with those in the three-component system discussed above. The mixing ratio of the phase separation controller is preferably 0.1 to 100 parts by weight, and more preferably 1 to 50 parts by weight with respect to 1 part by weight of the color former. This is so because, if the mixing ratio of the phase separation controller is less than 0.1 part by weight, no large improvement can be obtained in the coloring rate. If the mixing ratio of the phase separation controller exceeds 100 parts by weight, the glass transition point of the composition system becomes too low, and this poses a problem in the storage stability within the use temperature range.

In the recording medium of the present invention, a long-chain compound or the like can be properly mixed where necessary as a component other than the color former, the developer, the reversible material, and the phase separation controller. In addition, it is also possible to obtain any desired colored state by appropriately choosing a color former and mixing, e.g., a coloring dye in addition to the color former.

In the present invention, information recording and erasure are performed on the basis of the reversible crystalline-to-amorphous transition of a composition system containing the components as mentioned above. If the amorphous state of this composition system is unstable, therefore, crystallization proceeds in the entire system when the system is kept at room temperature or heated even slightly. As a consequence, the recorded information is erased. A crystallization temperature Tc at which crystallization of an amorphous substance proceeds changes in accordance with the heating rate. Generally, however, the crystallization temperature Tc is present in a temperature range between the glass transition temperature Tg and the melting point Tm. Therefore, in the present invention the glass transition temperature Tg when the composition system entirely or partially forms an amorphous substance is preferably 25° C. or higher, and more preferably 50° C. or higher. On the contrary, by using this phenomenon, e.g., by adjusting the glass transition temperature Tg of the composition system to close to room temperature, it is also possible to realize a recording medium by which recording information is stored only for a desired period and then naturally erased. Also, in some cases the glass transition temperature of the composition system is set to be lower than room temperature in order to use the system as a recording material for a certain special purpose. As an example, the glass transition temperature Tg of the composition system is set to be lower than room temperature, and the system is used to record a temporary temperature rise in a refrigerator for storing substances requiring refrigeration. In this case the temporary temperature rise which is caused by a failure of the refrigerator or when the refrigerator is transported can be recorded as a change in the colored state resulting from crystallization of the system. In the present invention, on the other hand, if the glass transition temperature Tg of the composition system is too high, a large thermal energy is required in crystallization by heating at a temperature equal to or higher than the crystallization temperature Tc and lower than the melting point Tm. Therefore, the glass transition temperature Tg of the composition system is preferably 150° C. or lower.

It is known that the glass transition temperature Tg of a mixture generally shows a weight-average value of the glass transition temperatures Tg of the mixed components. In the present invention, therefore, controlling the glass transition temperatures Tg of the individual components of the composition system is effective in setting the glass transition temperature Tg of the composition system to a desired value. For this reason, in the recording medium of the present invention, a component having a glass transition temperature of 25° C. or higher, preferably 50° C. or higher and capable of forming an amorphous substance is preferably used as each of the color former, the developer, and the matrix material to be mixed in the composition system. When this condition is taken into consideration, a compound with a large molecular weight and a small melting enthalpy change $\Delta H$ per unit weight as discussed earlier is suitable as the matrix material. Examples of the compound are those having a molecular skeleton which is close to a sphere and bulky and a polyvalent hydrogen-bonding compound capable of forming a plurality of hydrogen bonds between molecules. Note that the glass transition temperature Tg of the composition system or of each component of the system in the recording medium of the present invention can be measured using, e.g., a differential scanning calorimeter (DSC). In this case it is possible to perform the measurement for the entire composition system forming an amorphous substance or a portion of that system, or for each individual component of the system.

Figure 5:
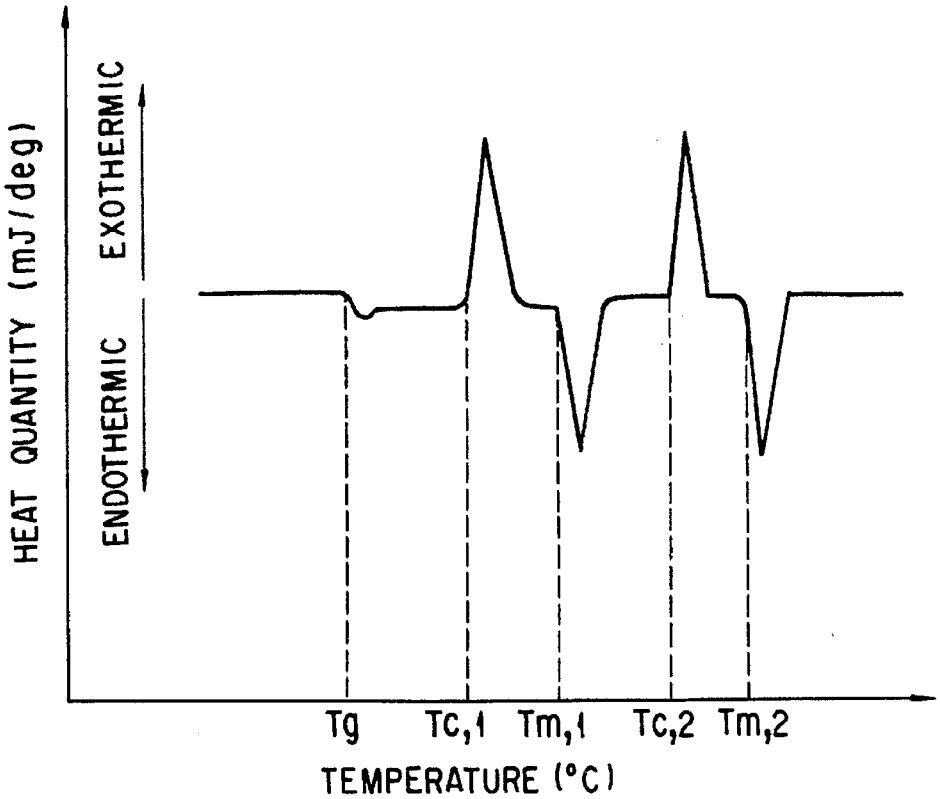
FIG. 5 is a graph showing the measurement result of the thermal characteristics when a composition system forms a plurality of crystal forms.

For a component which has a distinct glass transition temperature Tg and easily forms an amorphous substance, $Tg=a \cdot Tm$ is established between the glass transition temperature Tg and the melting point Tm as discussed earlier. In the present invention, therefore, if the glass transition temperature Tg of the composition system or of a component of the system is set high, the melting point Tm of the composition system also becomes high. This consequently accomplishes energy savings and an improvement in the thermal stability of the amorphous substance obtained. On the other hand, heating to a very high temperature is necessary in returning the crystalline substance to the amorphous substance by melting the crystalline substance and quenching or annealing to the glass transition temperature Tg or lower. Since this requires a substrate with a high heat resistance, the recording medium tends to become less practical. In the present invention, however, this inconvenience can be avoided since the composition system which forms a plurality of crystal forms is used as the recording material. FIG. 5 shows the measurement result of the thermal characteristics of the composition system which forms a plurality of crystal forms, obtained by using, e.g., a differential scanning calorimeter.

As in FIG. 5, the composition system which forms a plurality of crystal forms has two or more crystallization temperatures Tc (Tc,1, Tc,2) and two or more melting points Tm (Tm,1, Tm,2) on the thermal characteristic curve. In addition, the relation $Tg=a \cdot Tm$ is established for the higher Tm (Tm,2) in FIG. 5. That is, since this composition system has a melting point Tm (Tm,1) lower than the normal melting point (Tm,2) meeting the relation $Tg=Ta \cdot m$, the crystalline substance melts at temperatures equal to or higher than the melting point Tm (Tm,1) of a low-temperature crystal without raising the temperature during heating to be higher than the melting point Tm (Tm,2) of a high-temperature crystal. Therefore, by setting the glass transition temperature Tg of the system at a high value and applying the system to the recording material of the recording medium of the present invention, it is possible to achieve energy savings and an improvement in the thermal stability of the amorphous substance and at the same time to lower the heating temperature for returning the crystalline substance to the amorphous substance by melting. Note that in the present invention, to prepare a composition system which forms a plurality of crystal forms, it is only necessary to use a component capable of forming a plurality of crystal forms as the matrix material or as the developer whose mixing amount is large in the composition system.

The recording medium of the present invention can be obtained by melt-mixing a composition consisting of the components as described above in the absence of a solvent, and making the molten mixture amorphous by quenching or annealing. In this case any desired shape can be attained by molding the molten liquid in a mold. A thin film can also be formed by stretching the molten liquid. The formation of a thin film is also possible by dissolving the composition in an appropriate solvent and casting the solution. In the formation of a thin film, the thickness of the thin film is preferably 0.5 to 50 μm. This is so because, if the thickness of the thin film is too small, the coloring density in the colored state may become insufficient in the resultant recording medium. If, on the other hand, the thickness of the thin film is too large, a large thermal energy is required in recording and erasure, and this makes it difficult to perform recording and erasure at a high speed.

In the present invention, the composition as discussed above can be carried in some appropriate medium in order to improve the strength of the recording medium. For example, the composition can be formed into microcapsules, dispersed in a binder polymer, dispersed in inorganic glass, dispersed in a porous medium, or intercalated in a layered substance.

In the case where the composition as discussed above is dispersed in the binder polymer, the binder polymer serves to discourage occurrence of defects caused by repetitive phase separation or recrystallization. At the same time, the binder polymer lowers the concentrations of the color former and the developer, thereby decreasing the coloring in the decolored state, which means that the binder polymer functions as the matrix material defined in the present invention. To allow the binder polymer to hold the composition system of the present invention, it is possible to use a method by which a low-molecular component is caused to penetrate into a polymer compound or a method by which a low-molecular component is dispersed in a polymer compound and the dispersion is coated. Examples of the former penetration method are a method in which a composition consisting of a color former and a developer, and an optional reversible material, if necessary, is melted in the absence of a solvent and a sheet-like polymer compound is impregnated with the molten solution, and a method in which a composition consisting of the color former, the developer, and the optional reversible material is dissolved in a solvent and the solution is caused to penetrate into a sheet-like polymer compound at least a portion of which has a space capable of holding the composition consisting of the color former, the developer, and the optional reversible material. In addition, to obtain a uniform film thickness the surface of the material of the polymer compound preferably has wettability with respect to the composition consisting of the above two or three components or to the solution containing the composition. The latter coating method also has several choices. Examples of the dissolution and/or dispersion method are a method in which, from a solution containing a polymer compound, a color former and a developer, and an optional reversible material, if necessary, components to be dispersed are dispersed in the polymer compound by a proper dispersion method, and a method in which a composition consisting of the polymer compound, the color former, the developer, and the optional reversible material is heated in the absence of a solvent and components to be dispersed are dispersed in the polymer compound by a proper dispersion method.

Examples of the dispersion method are a mixer method, a sand mill method, a ball mill method, an impeller mill method, a colloid mill method, a three-roll mill method, a kneader method, a two-roll method, a Banbury mixer method, a homogenizer method, and a nanomizer method. These methods can be appropriately selected in accordance with the viscosity of the dispersion solution or the application or the form of the recording medium.

Examples of the coating method are spin coating, pull-up coating, air doctor coating, blade coating, rod coating, knife coating, squeeze coating, impregnation coating, reverse roll coating, transfer roll coating, gravure coating, kiss-roll coating, cast coating, spray coating, flood coating, calender coating, extrusion coating, electrostatic coating, and screen printing. These methods can be appropriately selected in accordance with the application or the form of the recording medium.

Examples of the polymer compound as described above are polyethylene, chlorinated polyethylene, ethylene copolymers such as etylene-vinyl acetate copolymer, and ethlene-acrylate-maleic anhydride copolymer, polybutadiene, polyesters such as polyethyleneterephthalate, polybutyleneterephthalate and polyethylenenaphthalate, polypropylene, polyisobutylene, polyvinyl chloride, polyvinylidene chloride, polyvinyl acetate, polyvinyl alcohol, polyvinyl acetal, polyvinyl butyral, ethylene tetrafluoride resin, ethylene chloride trifluoride resin, fluorinated ethlene propylene resins, ethylene tetrafluoride copolymers such as ethylene tetrafluoride-perfluoroalkoxyethylene copolymer, ethylene tetrafluoride-perfluoroalkyl vinyl ether copolymer, ethylene tetrafluoride-propylene hexafluoride copolymer, ethylene tetrafluoride-ethylene copolymer, fluorocarbon resins such as fluorine-containing polybenzoxazole, acrylic resins, metharylic resins, polyacrylonitrile, acrylonitrile copolymers such as acrylonitrile-butadiene-styrene copolymer, polystyrene, halogenated polystyrene, styrene copolymers such as styrene-methacrylate copolymer, styrene-acrylonitrile copolymer, acetal resins, polyamides such as Nylon 66, polycarbonates, polyestercarbonates, cellurose-based resins, phenolic resins, urea resins, epoxy resins, unsaturated polyester resins, alkyd resins, melamine resins, polyuretanes, diarylphthalate resins, polyphenylenesulfides, polysulfones, polyphenylenesulfones, silicone resins, polyimides, bismaleimide triazine resins, polyamidoimides, polyethersulfones, polymethylpentenes, polyether ketones, polyether imides, polyvinyl carbazoles, norbornene-based amorphous polyolefins. In addition, celluloses and neutral paper are favorable materials in that these materials facilitate penetration of compositions consisting of a relatively large number of types of color formers, developers, and optional reversible materials, and provide a high coloring density and a good colorlessness in a decolored state.

To suppress a decrease in the coloring density of the recording medium, the solubility of the color former, the developer, or the reversible material is preferably 10 g or less with respect to 100 g of the polymer compound. Also, the repeating unit constituted only by carbon, hydrogen, or a halogen element of the polymer compound is preferably larger than 75 wt %. More specifically, when the weight of (A)m is a and the weight of (B)n is b, $a/(a+b)>0.75$ is preferably satisfied in a polymer compound represented by the following formula:

$$-(A)_m-(B)_n-$$

(wherein A represents polyolefin or polystyrene, or polyolefin or polystyrene substituted by a halogen element, B represents a repeating unit containing at least an element other than carbon, hydrogen, and a halogen element, i.e., a repeating unit having a polar group containing a divalent or trivalent element, m represents an integer of 1 or more, and n represents an integer of 0 or more.)

A method of determining whether a color former, a developer, or a reversible material dissolves in a polymer compound will be described below by taking a color former as an example. If a polymer compound softens at the melting point of a color former, the color former is added to and well mixed with the polymer compound softened by heating, and the resultant composition is cooled to room temperature. Crystallization of the color former in the composition is observed using a microscope or by a common method such as X-ray diffraction or electron diffraction. Consequently, it is possible to determine whether the color former dissolves in the polymer compound in accordance with the presence/absence of a crystal. As an example, 1 g of the color former is added to and well mixed with 100 g of the polymer compound, and the resultant composition is cooled to room temperature. If a crystal is observed in the composition, the solubility of the color former with respect to 100 g of the polymer compound can be determined to be 1 g or less. On the other hand, if a polymer compound does not soften at the melting point of a color former, a solution in which the color former and the polymer compound are dissolved is coated by some appropriate coating method and dried. The resultant material is then heated to the melting point of the color former, thereby melting the color former. Thereafter, the resultant composition is cooled to room temperature, and crystallization of the color former in the composition is observed by a method similar to those discussed above. Consequently, whether the color former dissolves in the polymer compound can be determined in the same fashion as for a polymer compound which softens at the melting point of a color former.

The value of a/(a+b) of a polymer compound can be measured as follows. That is, materials constituting a polymer compound are specified by measuring the viscoelasticity or the IR of the polymer compound. Also, the mixing ratio of the constituent materials can be obtained by performing an elemental analysis for the polymer compound. The value of a/(a+b) can then be calculated from the weight and the mixing ratio of these constituent materials.

The above characteristics of the polymer compound are effective to suppress the decrease in the coloring density particularly in the case where the color former and the developer contents dispersed in the polymer compound are low.

To increase the rate of a crystalline-to-amorphous transition, of the color former, the development, and the optional reversible material dispersed in the polymer a composition system which causes the transition and a polymer compound preferably interact with each other to a certain degree. In this case a compound having a polar group is preferable as the polymer compound. Also, even if the polymer compound has no polar group, an interaction can be brought about by a Van der Waals force by increasing the mixing ratio of the polymer compound.

Examples of the polymer compound used for this purpose are polyethersulfone, polystyrene, polyethyleneisophthalate, polymethylpentene, a styrene-methyl methacrylate random copolymer, a styrene-methyl methacrylate block copolymer, polymethyl methacrylate, polyethylene, polyester, polyesterimide, polyamide, and polyimide.

Examples of the microcapsule formation technique mentioned above are an interfacial polymerization method, an in-situ polymerization method, an in-liquid hardening covering method, a phase separation from an aqueous solution system, a phase separation from an organic solution system, an in-gas suspension method, and a spray drying method. These methods can be properly chosen in accordance with the application or the form of the recording medium. In the present invention, it is also possible to disperse the microcapsules in the binder polymer or the inorganic glass discussed above. This makes it possible to obtain a well-dispersed form even if a composition is a medium insufficient in dispersibility.

Examples of the porous medium usable in the present invention are various types of polymers and inorganic compounds. Examples of the layered substance are a mica group, clay minerals, talc, and a prase group. The inorganic glass is preferably one that is manufacturable by a so-called sol-gel method and has not too high a gelation temperature in that case.

As discussed above, the form of the recording medium of the present invention is not particularly limited. That is, in addition to the form of a bulk, the recording medium can take a form in which a recording layer is formed as a thin film on a base material or a composite form with fibers. Examples of the base material are a plastic plate, a metal plate, a semiconductor substrate, a glass plate, paper, and an OHP sheet. In addition, in the form in which microcapsules are prepared as described above and coated on a base material as a paint or ink, color recording can be readily performed by using different types of color formers in these microcapsules. It is also possible to mix, at a desired mixing ratio, microcapsules containing different types of color formers and having different crystallization temperatures Tc or different melting points Tm. In this case the colored state can be controlled in accordance with the magnitude of a supplied thermal energy. Consequently, full-color recording using color formers of, e.g., cyan, magenta, and yellow is possible.

In the recording medium of the present invention, a protective layer made from wax, a thermoplastic resin, a thermosetting resin, or a photocurable resin and having a thickness of about 0.1 to 100 μm can also be formed if necessary.

This protective layer can be formed by a method in which a solution containing a protective layer component as described above or a solution in which a protective layer component is dissolved or dispersed in a solvent is coated on the layer of the recording medium and dried. The protective film can also be formed by adhering a heat-resistant film or a heat-resistant film on which an adhesive is coated to the layer of the recording medium by a dry laminate method.

The heat-resistant film is not particularly limited so long as the film has a heat deformation temperature higher than the melting points of a color former, a developer, and an optional reversible material. Examples of such a sheet-like polymer compound are polyetheretherketones; polycarbonates; polyallylates; polysulfones; ethylene tetrafluoride resins; ethylene tetrafluoride copolymers such as an ethylene tetrafluoride-perfluoroalkoxyethylene copolymer, an ethylene tetrafluoride-perfluoroalkylvinylether copolymer, an ethylene tetrafluoride-propylene hexafluoride copolymer, and an ethylene tetrafluoride-ethylene copolymer; ethylene chloride trifluoride resins; vinylidene fluoride resins; fluorine-containing polybenzoxazoles; polypropylenes; polyvinylalcohols; polyvinylidene chlorides; polyesters such as polyethyleneterephthalate, polybutyleneterephthalate, and polyethylenenaphthalate; polystyrenes; polyamides such as Nylon 66; polyimides; polyimidoamides; polyethersulfones; polymethylpentenes; polyetherimides; polyurethanes; and polybutadienes. These compounds can be appropriately selected in accordance with the thermal energy application method or the intended use or the form of the recording medium.

The heat-resistant film need only be adhered to the reversible thermal recording medium of the present invention via an adhesive. As the adhesive, any material generally used in a dry laminate method can be used. Examples are acrylic resins, phenoxy resins, ionomer resins, ethylene copolymers such as an ethylene-vinyl acetate copolymer and an ethylene-acrylic acid-maleic anhydride copolymer, polyvinylethers, polyvinylformals, polyvinylbutylals, polyesters, polystyrenes, styrene copolymers such as a styrene-acrylic acid copolymer, vinyl acetate resins, polyesters, polyurethanes, xylene resins, epoxy resins, phenolic resins, and urea resins.

In the recording medium of the present invention, an undercoating layer can be formed, where necessary, between the layer of the recording medium and the base material for the purposes of, e.g., improving the adhesion between the layer of the recording medium and the base material, preventing penetration of the composition into the base material upon application of heat, improving the heat resistance, and improving the solvent resistance.

To perform recording or erasure in the recording medium of the present invention, it is only necessary to supply thermal energies of two different values as discussed earlier. More specifically, a thermal head or a laser beam can be preferably used to supply thermal energy in recording. A thermal head is preferable, although its resolving power is not so high, because of its ability to heat a large area regardless of whether the substance is crystalline or amorphous. A laser beam whose spot diameter can be made small is preferable since high-density recording is possible. However, in supplying thermal energy to the recording medium of the present invention by using a laser beam, the laser beam must be efficiently absorbed even in an amorphous substance with a high transparency. For this purpose, it is usually preferable to form a light-absorbing layer having an absorption band corresponding to the wavelength of the laser beam or to mix a compound having an absorption band corresponding to the wavelength of the laser beam in the composition system. In performing erasure, on the other hand, thermal energy is preferably supplied by a hot stamper method or a heated roller method by which the entire recording medium can be heated at once. Although the recording medium thus heated can be annealed, it is more preferable to quench the medium in accordance with a cold stamper method, a cold roller method, or an air-cooling method using a cold air stream. Furthermore, in the recording medium of the present invention it is also possible to perform overwrite recording by use of a plurality of laser beams different in, e.g., energy or spot diameter.

EXAMPLES

The present invention will be described below by way of its examples.

Example 1

1.0 part by weight of Crystal Violet lactone as a color former, 1.0 part by weight of propyl gallate as a developer, and 50 parts by weight of methylandrostenediol as a matrix material were blended and thermally melted to yield a homogeneous composition. The measurement results by differential scanning calorimetry (DSC) were as follows. The Crystal Violet lactone and the methylandrostenediol had glass transition temperatures Tg of 64° C. and 71° C., respectively, and these components formed stable amorphous substances at room temperature. On the other hand, the propyl gallate did not form any stable amorphous substance because it was highly crystallizable. The overall composition system had a glass transition temperature Tg of 70° C. and was found to form a stable amorphous substance at room temperature.

Thereafter, a small amount of the above composition was melted on a 1.5-mm thick glass substrate. A 1-mm glass plate to which a slight amount of silica particles, as spacers, about 10 μm in diameter were adhered was placed on the glass substrate to spread the molten solution on the entire surface of the substrate. The resultant structure was annealed at room temperature. The glass plate was then removed, and it was found that a transparent thin amorphous film about 10 μm thick was formed on the glass substrate. Subsequently, a photocurable epoxy resin was coated on the thin amorphous film and optically cured, forming a 1-μm thick protective film. In addition, to return a portion of the thin amorphous film that crystallized during the formation of the protective film to the amorphous state, the entire surface was pressed with a heated roll, and the resultant material was annealed at room temperature. In this manner, a recording medium of the present invention was obtained.

Figure 6:
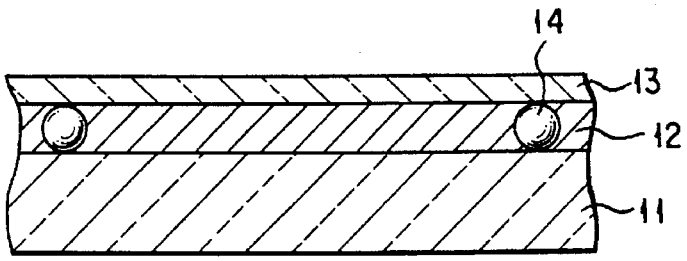
FIG. 6 is a longitudinal sectional view showing an example of the recording medium of the present invention.

FIG. 6 is a longitudinal sectional view of the resultant recording medium. As in FIG. 6, in this recording medium a recording layer 12 in the form of a thin film is formed on a glass substrate 11 as a base. Note that in FIG. 6, reference numeral 13 denotes the protective film; and 14, the spacers consisting of silica particles.

Thermal printing was performed on the recording medium with an applied voltage of 10 V and a pulse width of 1 msec by using a thermal head (6 dot/mm, 380 Ω) manufactured by TOSHIBA CORP. As a consequence, the printed portion crystallized to turn blue, indicating that positive type recording was performed. Note that the peak absorbances of the printed portion and the background with respect to light having a wavelength of 610 nm were 1.7 and 0.04, respectively, and the contrast ratio between these portions was 43. The reported value of the contrast ratio of the composition system disclosed in "The 42nd Polymer Forum Preprints", 1993, page 2,736, is at most about 10. This signifies that a display with a very high contrast ratio was accomplished in the present invention. Thereafter, the entire surface of the recording medium was pressed by the heated roll, and the medium was left to stand at room temperature. Consequently, the printed portion returned to the transparent amorphous state, i.e., it was confirmed that erasure was done. No deterioration took place even after similar recording and erasure were performed 100 cycles. Also, no change was found in the printed state even after the medium was left to stand at 30° C. for one year.

Meanwhile, the entire surface of the recording medium was pressed by a heated roll at a temperature lower than that of the heated roll described above. Thereafter, the recording medium was annealed at room temperature to crystallize the whole thin amorphous film. Consequently, the film turned blue. The same thermal head (6 dot/mm, 380 Ω) as discussed above was then used to perform thermal printing on the recording medium with an applied voltage of 15 V and a pulse width of 2 msec. As a result, the printed portion changed into an amorphous state, i.e., turned colorless and transparent, demonstrating that negative type recording was done. Note that the contrast ratio between the printed portion and the background, the stability in repetitive recording and erasure, and the storage stability of the printed state were equivalent to those in the case of the positive type recording discussed above.

Example 2

1.0 part by weight of Crystal Violet lactone as a color former, 1.0 part by weight of propyl gallate as a developer, and 50 parts by weight of methylandrostenediol as a matrix material were dissolved in ethanol. The resultant ethanol solution was coated on a 1.5-mm thick glass substrate and dried to form a partially opaque thin film about 15 μm in thickness. Subsequently, a photocurable epoxy resin was coated on the resultant thin film and optically cured to form a 1-μm thick protective film. In addition, to change the entire thin film that was partially crystallized into an amorphous substance, the entire surface was pressed by a heated roll, and the resultant material was annealed at room temperature. In this manner, a recording medium of the present invention was obtained.

Thermal printing was performed on the recording medium with an applied voltage of 11 V and a pulse width of 1 msec by using a thermal head (6 dot/mm, 380 Ω) manufactured by TOSHIBA CORP. As a consequence, the printed portion crystallized to turn blue, indicating that positive type recording was performed. Note that the peak absorbances of the printed portion and the background with respect to light having a wavelength of 610 nm were 1.9 and 0.05, respectively, and the contrast ratio between these portions was 38. Subsequently, the entire surface of the recording medium was pressed by the heated roll, and the medium was left to stand at room temperature. Consequently, the printed portion returned to the transparent amorphous state, i.e., it was confirmed that erasure was done. No deterioration took place even after similar recording and erasure were performed 100 cycles. Also, no change was found in the printed state even after the medium was left to stand at 30° C. for one year.

Meanwhile, the entire surface of the recording medium was pressed by a heated roll at a temperature lower than that of the heated roll described above. Thereafter, the recording medium was annealed at room temperature to crystallize the whole thin amorphous film. Consequently, the film turned blue. The same thermal head (6 dot/mm, 380 Ω) as discussed above was then used to perform thermal printing on the recording medium with an applied voltage of 15 V and a pulse width of 2 msec. Then, the printed portion changed into an amorphous state, i.e., turned colorless and transparent, demonstrating that negative type recording was done. Note that the contrast ratio between the printed portion and the background, the stability in repetitive recording and erasure, and the storage stability of the printed state were equivalent to those in the case of the positive type recording discussed above.

Example 3

A recording medium of the present invention was formed following the same procedure as in Example 1 except that a fluoran-based leuco compound PSD-V manufactured by Nippon Soda Co., Ltd. was used as a color former in place of Crystal Violet lactone. Thermal printing was performed on the recording medium with an applied voltage of 10 V and a pulse width of 1 msec by using a thermal head (6 dot/mm, 380 Ω) manufactured by TOSHIBA CORP. As a consequence, the printed portion turned vermilion upon crystallization, indicating that positive type recording was performed. Subsequently, the same thermal head was used to sequentially heat the entire surface of the recording medium with an applied voltage of 15 V and a pulse width of 2 msec. The printed portion then returned to the transparent amorphous state, i.e., it was confirmed that erasure was done. No deterioration took place even after similar recording and erasure were performed 100 cycles. Also, no change was found in the printed state even after the medium was left to stand at 30° C. for one year.

Example 4

A recording medium of the present invention was formed following the same procedure as in Example 1 except that a fluoran-based leuco compound PSD-290 manufactured by Nippon Soda Co., Ltd. was used as a color former in place of Crystal Violet lactone. Thermal printing was performed on the recording medium with an applied voltage of 10 V and a pulse width of 1 msec by using a thermal head (6 dot/mm, 380 Ω) manufactured by TOSHIBA CORP. As a consequence, the printed portion turned black upon crystallization, indicating that positive type recording was performed. Subsequently, the entire surface of the recording medium was pressed by a heated roll, and the medium was left to stand at room temperature. The printed portion then returned to the transparent amorphous state, i.e., it was confirmed that erasure was done. No deterioration took place even after similar recording and erasure were performed 100 cycles. Also, no change was found in the printed state even after the medium was left to stand at 30° C. for one year.

Example 5

A recording medium of the present invention was formed following the same procedure as in Example 1 except that 50 parts by weight of cholesterol and 10 parts by weight of 5β-cholanic acid were used as matrix materials in place of 50 parts by weight of methylandrostenediol. Note that as a result of differential scanning calorimetry, it was confirmed that the whole composition system formed a stable amorphous substance with a glass transition temperature Tg of 27° C.

Thermal printing was performed on the recording medium with an applied voltage of 10 V and a pulse width of 1 msec by using a thermal head (6 dot/mm, 380 Ω) manufactured by TOSHIBA CORP. As a consequence, the printed portion crystallized to turn blue, indicating that positive type recording was performed. Subsequently, the entire surface of the recording medium was pressed by a heated roll, and the medium was left to stand at room temperature. As a result, the printed portion returned to the transparent amorphous state, i.e., it was confirmed that erasure was done. Note that when the recording medium was left to stand at 30° C. for one day, the entire surface of the printed portion crystallized to turn blue. This indicates that the information was naturally erased in a short period of time.

Example 6

A recording medium of the present invention was formed following the same procedure as in Example 2 except that 10 parts by weight of pregnenolone were used as a matrix material instead of 50 parts by weight of methylandrostenediol. Note that as a result of differential scanning calorimetry, it was confirmed that the pregnenolone formed a stable amorphous substance with a glass transition temperature Tg of 58° C., and that the whole composition system formed a stable amorphous substance with a glass transition temperature Tg of 36° C.

Thermal printing was performed on the recording medium with an applied voltage of 10 V and a pulse width of 1 msec by using a thermal head (6 dot/mm, 380 Ω) manufactured by TOSHIBA CORP. As a consequence, the printed portion crystallized to turn blue, indicating that positive type recording was performed. Subsequently, the same thermal head was used to sequentially heat the entire surface of the recording medium with an applied voltage of 15 V and a pulse width of 2 msec. The printed portion then returned to the transparent amorphous state, i.e., it was confirmed that erasure was done. No deterioration took place even after similar recording and erasure were performed 100 cycles. Also, no change was found in the printed state even after the medium was left to stand at 30° C. for one year.

Example 7

A recording medium of the present invention was formed following the same procedure as in Example 2 except that a fluoran-based leuco compound PSD-V manufactured by Nippon Soda Co., Ltd. was used as a color former in place of Crystal Violet lactone. Thermal printing was performed on the recording medium with an applied voltage of 11 V and a pulse width of 1 msec by using a thermal head (6 dot/mm, 380 Ω) manufactured by TOSHIBA CORP. As a consequence, the printed portion turned vermilion upon crystallization, indicating that positive type recording was performed. Subsequently, the same thermal head was used to sequentially heat the entire surface of the recording medium with an applied voltage of 15 V and a pulse width of 2 msec. As a result, the printed portion returned to the transparent amorphous state, i.e., it was confirmed that erasure was done. No deterioration took place even after similar recording and erasure were performed 100 cycles. Also, no change was found in the printed state even after the medium was left to stand at 30° C. for one year.

Example 8

A recording medium of the present invention was formed following the same procedure as in Example 5 except that a fluoran-based leuco compound Indolyl Red manufactured by Yamamoto Chemicals Inc. was used as a color former in place of Crystal Violet lactone. Thermal printing was performed on the recording medium with an applied voltage of 10 V and a pulse width of 1 msec by using a thermal head (6 dot/mm, 380 Ω) manufactured by TOSHIBA CORP. As a consequence, the printed portion turned red upon crystallization, indicating that positive type recording was performed. Subsequently, the entire surface of the recording medium was pressed by a heated roll, and the medium was left to stand at room temperature. The printed portion then returned to the transparent amorphous state, i.e., it was confirmed that erasure was done. Note that when the recording medium was left to stand at 30° C. for one day, the entire surface of the printed portion turned red upon crystallization. This indicates that the information was naturally erased in a short period of time.

Example 9

A recording medium of the present invention was formed following the same procedure as in Example 2 except that a fluoran-based leuco compound PSD-3G manufactured by Nippon Soda Co., Ltd. was used as a color former in place of Crystal Violet lactone. Thermal printing was performed on the recording medium in accordance with a hot stamp method. As a consequence, the printed portion turned green upon crystallization, indicating that positive type recording was performed. Subsequently, the entire surface of the recording medium was pressed with a heated roll, and the medium was left to stand at room temperature. The printed portion then returned to the transparent amorphous state, i.e., it was confirmed that erasure was done. No deterioration took place even after similar recording and erasure were performed 100 cycles. Also, no change was found in the printed state even after the medium was left to stand at 30° C. for one year.

Example 10

1.0 part by weight of Crystal Violet lactone as a color former, 1.0 part by weight of propyl gallate as a developer, and 50 parts by weight of methylandrostenediol as a matrix material were blended and thermally melted to yield a homogeneous composition. Thereafter, a small amount of the above composition was melted on a 1.2-mm thick glass substrate which was optically polished and on which a 100-nm thick Cr layer was vacuum-deposited as a light-absorbing layer. A glass plate was then placed on the glass substrate to spread the molten solution on the entire surface of the substrate. Subsequently, the molten solution was cooled by pressing the glass substrate against an aluminum plate which was cooled with water, thereby forming a thin amorphous film about 10 μm thick as a recording layer. In this manner, a recording medium of the present invention constituted by the glass substrate, the light-absorbing layer, the recording layer, and the glass plate was manufactured.

While the resultant recording medium was rotated at 900 rpm, a write operation in the recording layer was performed by irradiating a semiconductor laser beam converged into a diameter of 1 μm and having a wavelength of 830 nm such that the intensity on the surface of the recording medium was 1 mW. It was confirmed by observation using a polarizing microscope that the write portion that was irradiated with the laser beam crystallized with a clear contrast. That is, it was found that a line about 1 μm wide was recorded. Subsequently, a semiconductor laser beam converged into a diameter of 2 μm and having a wavelength of 830 nm was so irradiated that the intensity on the surface of the recording medium was 8 mW. When the resultant medium was observed with the polarizing microscope, it was confirmed that the write portion also turned amorphous in the region irradiated with the laser beam with an intensity of 8 mW, demonstrating that erasure was accomplished. Note that no change was found in the write state even after the recording medium was left to stand at 30° C. for one year.

Example 11

A recording medium of the present invention was obtained following the same procedure as in Example 2 except that estradiol benzoate was used as a matrix material in place of methylandrostenediol. The measurement results by differential scanning calorimetry were as follows. It was found that the estradiol benzoate formed a stable amorphous substance with a glass transition temperature Tg of 52° C., and that the entire composition system formed a stable amorphous substance with a glass transition temperature Tg of 51° C. It was also found that this composition system formed a plurality of crystal forms, the melting point of a low-temperature crystal was approximately 140° C., the melting point of a high-temperature crystal was approximately 180° C., and a colorless, transparent amorphous substance was formed when the low-temperature crystal was melted and then annealed at room temperature.

Thermal printing was performed on the recording medium with an applied voltage of 10 V and a pulse width of 1 msec by using a thermal head (6 dot/mm, 380 Ω) manufactured by TOSHIBA CORP. As a consequence, the printed portion crystallized to turn blue, indicating that positive type recording was performed. Subsequently, the entire surface of the recording medium was pressed by a heated roll, and the medium was left to stand at room temperature. Consequently, the printed portion returned to the transparent amorphous state, i.e., it was confirmed that erasure was done. No deterioration took place even after similar recording and erasure were performed 100 cycles. Also, no change was found in the printed state even after the medium was left to stand at 30° C. for one year.

Meanwhile, the entire surface of the recording medium was pressed by a heated roll at a temperature lower than that of the heated roll described above. Thereafter, the recording medium was annealed at room temperature to crystallize the whole thin amorphous film. Consequently, the film turned blue. The same thermal head (6 dot/mm, 380 Ω) as discussed above was then used to perform thermal printing on the recording medium with an applied voltage of 13 V and a pulse width of 2 msec. The printed portion then changed into an amorphous state, i.e., turned colorless and transparent, demonstrating that negative type recording was done. Note that the contrast ratio between the printed portion and the background, the stability in repetitive recording and erasure, and the storage stability of the printed state were equivalent to those in the case of the positive type recording discussed above.

Example 12

A recording medium of the present invention was formed following the same procedure as in Example 1 except that 10 parts by weight of cholesterol were used as a matrix material in place of 50 parts by weight of methylandrostenediol. Note that as a result of differential scanning calorimetry, it was confirmed that the whole composition system formed a stable amorphous substance with a glass transition temperature Tg of 27° C.

Thermal printing was performed on the recording medium with an applied voltage of 10 V and a pulse width of 1 msec by using a thermal head (6 dot/mm, 380 Ω) manufactured by TOSHIBA CORP. As a consequence, the printed portion crystallized to turn blue, indicating that positive type recording was performed. Subsequently, the entire surface of the recording medium was pressed by a heated roll, and the medium was left to stand at room temperature. As a result, the printed portion returned to the transparent amorphous state, i.e., it was confirmed that erasure was done. Note that when the recording medium was left to stand at 30° C. for one day, the entire surface of the printed portion crystallized to turn blue. This indicates that the information was naturally erased in a short period of time.

Example 13

A recording medium of the present invention was formed following the same procedure as in Example 1 except that α,α,α'-tris(4-hydroxyphenyl)-1-ethyl-4-isopropylbenzene was used as a developer instead of propyl gallate. Note that as a result of differential scanning calorimetry, it was confirmed that the α,α,α'-tris(4-hydroxyphenyl)-1-ethyl-4-isopropylbenzene in this composition system formed a stable amorphous substance with a glass transition temperature Tg of 88° C.

Thermal printing was performed on the recording medium with an applied voltage of 10 V and a pulse width of 1 msec by using a thermal head (6 dot/mm, 380 Ω) manufactured by TOSHIBA CORP. As a consequence, the printed portion crystallized to turn blue, indicating that positive type recording was performed. Subsequently, the entire surface of the recording medium was pressed by a heated roll, and the medium was left to stand at room temperature. As a result, the printed portion returned to the transparent amorphous state, i.e., it was confirmed that erasure was done. No deterioration took place even after similar recording and erasure were performed 100 cycles. Also, no change was found in the printed state even after the medium was left to stand at 35° C. for one year.

Example 14

1.0 part by weight of Crystal Violet lactone as a color former, 1.0 part by weight of α,α,α'-tris(4-hydroxyphenyl)-1-ethyl-4-isopropylbenzene as a developer, and 10 parts by weight of cholesterol as a matrix material were dissolved in ethanol. The resultant ethanol solution was coated on a 100-μm thick polystyrene film and dried to form a thin amorphous film about 2 μm in thickness. Subsequently, a 40-μm thick polystyrene film was adhered on the thin amorphous film with heat and pressure. In this manner, a recording medium of the present invention was obtained.

Thermal printing was performed on the recording medium with an applied voltage of 10 V and a pulse width of 1 msec by using a thermal head (6 dot/mm, 380 Ω) manufactured by TOSHIBA CORP. As a consequence, the printed portion crystallized to turn blue, indicating that positive type recording was performed. Note that the peak absorbances of the printed portion and the background with respect to light having a wavelength of 610 nm were 1.4 and 0.02, respectively, and the contrast ratio between these portions was 70. Subsequently, the entire surface of the recording medium was pressed by a heated roll, and the medium was left to stand at room temperature. Consequently, the printed portion returned to the transparent amorphous state, i.e., it was confirmed that erasure was done. No deterioration took place even after similar recording and erasure were performed 100 cycles. Also, no change was found in the printed state even after the medium was left to stand at 30° C. for one year.

Example 15

Figure 7:
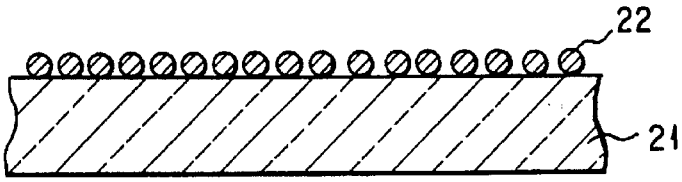
FIG. 7 is a longitudinal sectional view showing another example of the recording medium of the present invention.

1.0 part by weight of Crystal Violet lactone as a color former, 1.0 part by weight of bisphenol A lithium salt as a developer, and 70 parts by weight of 1,3-bis(4'-t-butylbiphenyl-4-oxycarbonyl)-benzene as a matrix material were blended and thermally melted to yield a homogeneous composition. 0.5 g of hexamethylenebischloroformate were mixed in 30 g of the resultant composition, and the mixture was thermally melted. Thereafter, the resultant mixture was dropped into 200 g of an aqueous 5-wt % gelatin solution under stirring so that fine droplets were formed. A solution that was prepared beforehand by dissolving 3 g of hexamethylenediamine in 50 g of water was gradually dropped into the solution under stirring, and the stirring was continued at about 40° C. for five hours. Consequently, the hexamethylenebischloroformate reacted with the hexamethylenediamine in the interface between the fine droplets of the composition and water, synthesizing polyurethane in the form of a solid that was insoluble in water and the composition. This polyurethane covered the composition. As a result, microcapsules containing the color former, the developer, and the matrix material were produced in the aqueous suspension. Thereafter, the aqueous suspension of the microcapsules was coated on copy paper and dried. The entire surface of the copy paper was pressed with a heated roll, and the copy paper was annealed at room temperature. Then, a recording medium of the present invention in which a recording layer consisting of the microcapsules containing the amorphous composition was formed on the paper surface was obtained. FIG. 7 is a longitudinal sectional view of the resultant recording medium. In FIG. 7, reference numeral 21 denotes the copy paper as a base; and 22, the microcapsules serving as a recording layer. Note that it is also possible to extract the microcapsules from the aqueous suspension by any of filtration, centrifugal separation, and drying before being used.

Thermal printing was performed on the recording medium with an applied voltage of 10 V and a pulse width of 1 msec by using a thermal head (6 dot/mm, 380 Ω) manufactured by TOSHIBA CORP. As a consequence, in the printed portion the composition in the microcapsules crystallized to turn blue, indicating that positive type recording was performed. Subsequently, the entire surface of the recording medium was pressed by the heated roll, and the medium was left to stand at room temperature. The printed portion was then decolorized as it returned to the amorphous state, i.e., it was confirmed that erasure was done. Note that no change was found in the printed state even after the medium was left to stand at 30° C. for one year.

Example 16

1.0 part by weight of Crystal Violet lactone as a color former, 1.0 part by weight of ethyl gallate as a developer, and 50 parts by weight of methylandrostenediol as a matrix material were blended and thermally melted to yield a homogeneous composition. Subsequently, 4 parts by weight of the resultant composition and 100 parts by weight of a thermosetting epoxy resin were kneaded. The kneaded material was then molded into a cube with dimensions of 1 cm×1 cm×1 cm and thermally set. In this manner, a recording medium of the present invention was obtained. The resultant recording medium was heated to 200° C. and cooled with an air stream. Consequently, it was found that the bulk of the cube became amorphous to turn light blue, indicating that positive type recording was done. Subsequently, the recording medium was heated to 100° C. and cooled to room temperature. As a result, the bulk changed its colored state to dark blue upon crystallization, demonstrating that erasure was performed. No deterioration was found even after similar recording and erasure were performed 100 cycles.

Example 17

1.0 part by weight of C.I. Basic Blue 3 as a color former, 4.0 parts by weight of benzenesulfonic acid as a developer, and 50 parts by weight of methylandrostenediol as a matrix material were blended and thermally melted to yield a homogeneous composition. Note that the color former and the developer used in this example are components which are deprived of a color when the interaction between them increases and develop a color when the interaction decreases. A small amount of the above composition was melted on a 1.5-mm thick glass substrate. A 1-mm glass plate to which a slight amount of silica particles, as spacers, about 10 μm in diameter were adhered was placed on the glass substrate to spread the molten solution on the entire surface of the substrate. The resultant structure was annealed at room temperature. The glass plate was then removed, and it was found that a thin blue amorphous film about 10 μm thick was formed on the glass substrate. Subsequently, a photocurable epoxy resin was coated on the thin amorphous film and optically cured, forming a 1-μm thick protective film. In addition, the entire surface was pressed with a heated roll, and the resultant material was annealed at room temperature, thereby crystallizing the thin amorphous film into a white crystalline substance. In this manner, a recording medium of the present invention was obtained.

Thermal printing was performed on the recording medium with an applied voltage of 15 V and a pulse width of 2 msec by using a thermal head (6 dot/mm, 380 Ω) manufactured by TOSHIBA CORP. As a consequence, the printed portion turned blue as it became amorphous, indicating that positive type recording was performed. Subsequently, the entire surface of the recording medium was pressed by the heated roll, and the medium was left to stand at room temperature. Consequently, the printed portion returned to the white crystalline state, i.e., it was confirmed that erasure was done. No deterioration took place even after similar recording and erasure were performed 100 cycles. Also, no change was found in the printed state even after the medium was left to stand at 30° C. for one year.

Example 18

1.0 part by weight of Crystal Violet lactone as a color former and 4.0 parts by weight of cholestane-3-yl 4-hydroxy benzoate as a developer were blended and thermally melted to yield a homogeneous composition. Note that as a result of differential scanning calorimetry, it was confirmed that the cholestane-3-yl 4-hydroxy benzoate in this composition system formed a stable amorphous substance with a glass transition temperature Tg of 35° C.

Thereafter, a small amount of the above composition was melted on a 1.5-mm thick glass substrate. A 1-mm glass plate to which a slight amount of silica particles, as spacers, about 10 μm in diameter were adhered was placed on the glass substrate to spread the molten solution on the entire surface of the substrate. The resultant structure was annealed at room temperature. The glass plate was then removed, and it was found that a thin blue amorphous film about 10 μm thick was formed on the glass substrate. Subsequently, a photocurable epoxy resin was coated on the thin amorphous film and optically cured, forming a 1-μm thick protective film. In addition, the entire surface was pressed with a heated roll, and the resultant material was annealed at room temperature, thereby crystallizing the thin amorphous film into a white crystalline substance. In this manner, a recording medium of the present invention was obtained.

Thermal printing was performed on the recording medium with an applied voltage of 15 V and a pulse width of 2 msec by using a thermal head (6 dot/mm, 380 Ω) manufactured by TOSHIBA CORP. As a consequence, the printed portion turned blue as it became amorphous, indicating that positive type recording was performed. Subsequently, the entire surface of the recording medium was pressed by the heated roll, and the medium was left to stand at room temperature. Consequently, the printed portion returned to the white crystalline state, i.e., it was confirmed that erasure was done. No deterioration took place even after similar recording and erasure were performed 100 cycles. Also, no change was found in the printed state even after the medium was left to stand at 30° C. for one year.

Example 19

A recording medium of the present invention was formed following the same procedure as in Example 18 except that 14 parts by weight of estradiol were used as a developer in place of cholestane-3-yl 4-hydroxy benzoate. Note that as a result of differential scanning calorimetry, it was confirmed that the estradiol in this composition system formed a stable amorphous substance with a glass transition temperature Tg of 76° C.

Thermal printing was performed on the recording medium with an applied voltage of 15 V and a pulse width of 2 msec by using a thermal head (6 dot/mm, 380 Ω) manufactured by TOSHIBA CORP. As a consequence, the printed portion turned blue as it became amorphous, indicating that positive type recording was performed. Subsequently, the entire surface of the recording medium was pressed by a heated roll, and the medium was left to stand at room temperature. Consequently, the printed portion returned to the white crystalline state, i.e., it was confirmed that erasure was done. No deterioration took place even after similar recording and erasure were performed 100 cycles. Also, no change was found in the printed state even after the medium was left to stand at 30° C. for one year.

Example 20

1.0 part by weight of phenolphthalein as a color former, 1.0 part by weight of stearylamine as a developer, and 20 parts by weight of methylandrostenediol as a matrix material were dissolved in ethanol. The resultant ethanol solution was coated on a 1.5-mm thick glass substrate and dried to form a partially opaque thin film about 15 μm in thickness. Subsequently, a photocurable epoxy resin was coated on the resultant thin film and optically cured to form a 1-μm thick protective film. In addition, to change the entire thin film that partially crystallized into an amorphous substance, the entire surface was pressed by a heated roll, and the resultant material was annealed at room temperature. In this manner, a recording medium of the present invention was obtained.

Thermal printing was performed on the recording medium with an applied voltage of 10 V and a pulse width of 1 msec by using a thermal head (6 dot/mm, 380 Ω) manufactured by TOSHIBA CORP. As a consequence, the printed portion turned pink upon crystallization, indicating that positive type recording was performed. Subsequently, the entire surface of the recording medium was pressed by the heated roll, and the medium was left to stand at room temperature. Consequently, the printed portion returned to the transparent amorphous state, i.e., it was confirmed that erasure was done. No deterioration took place even after similar recording and erasure were performed 100 cycles. Also, no change was found in the printed state even after the medium was left to stand at 30° C. for one year.

Meanwhile, the entire surface of the recording medium was pressed by a heated roll at a temperature lower than that of the heated roll described above. Thereafter, the recording medium was annealed at room temperature to crystallize the whole thin amorphous film. Consequently, the film turned pink. The same thermal head (6 dot/mm, 380 Ω) as discussed above was then used to perform thermal printing on the recording medium with an applied voltage of 15 V and a pulse width of 2 msec. As a result, the printed portion change into an amorphous state, i.e., became colorless and transparent, indicating that negative type recording was done. Note that the stability in repetitive recording and erasure, and the storage stability of the printed state were equivalent to those in the case of the positive type recording discussed above.

Example 21

1 part by weight of PSD-HR manufactured by Nippon Soda Co., Ltd. as a color former, 1 part by weight of α,α,α'-tris(4-hydroxyphenyl)-1-ethyl-4-isopropylbenzene as a developer, and 20 parts by weight of pregnenolone as a matrix material were melt-mixed and quenched. The resultant amorphous solid material was finely milled by using a ball mill. The resultant powder was dispersed in an aqueous 8% solution of gum arabic under stirring. An aqueous gelatin solution was mixed at 40° C., and the resultant solution was stirred for one hour. Water was added to dilute the solution, and the solution was stirred. An aqueous 10% acetic acid solution was added to adjust the pH to 3.9. 37% formalin was added, and the pH was adjusted to 7.0. The resultant solution was cooled to 5° C. and left to stand at room temperature for three days. The resultant microcapsules were separated by a centrifugal separator to obtain microcapsules A for red color.

Subsequently, microcapsules B for yellow color were manufactured following the same procedure as above except that 1.0 part by weight of Y-1 available from Yamamoto Chemicals Inc. was used as a color former, 1.0 part by weight of α,α,α'-tris(4-hydroxyphenyl)-1-ethyl-4-isopropylbenzene was used as a developer, and 20 parts by weight of cholesterol were used as a matrix material.

Thereafter, an aqueous suspension in which these two types of microcapsules were mixed was coated on copy paper and dried. The entire surface of the copy paper was pressed with a heated roll, and the copy paper was annealed at room temperature. The result was a recording medium of the present invention in which a recording layer consisting of the microcapsules containing the amorphous composition was formed on the paper surface.

Thermal printing was performed on the recording medium with an applied voltage of 9 V and a pulse width of 1 msec by using a thermal head (6 dot/mm, 380 Ω) manufactured by TOSHIBA CORP. As a consequence, the printed portion turned yellow to indicate that recording was performed. Subsequently, the entire surface of the recording medium was pressed by the heated roll, and the medium was left to stand at room temperature. Then, the printed portion was decolored as it returned to the amorphous state, i.e., it was confirmed that erasure was done.

The same thermal head available from TOSHIBA CORP. was used to perform thermal printing on the recording medium with an applied voltage of 11 V and a pulse width of 1 msec. Consequently, the printed portion turned orange to indicate that recording was performed. Subsequently, the entire surface of the recording medium was pressed by the heated roll, and the medium was left to stand at room temperature. As a result, the printed portion was decolored as it returned to the amorphous state, i.e., it was confirmed that erasure was done.

The same thermal head available from TOSHIBA CORP. was used to perform thermal printing on the recording medium with an applied voltage of 13 V and a pulse width of 1 msec. Consequently, the printed portion turned red to indicate that recording was performed. Subsequently, the entire surface of the recording medium was pressed by the heated roll, and the medium was left to stand at room temperature. The result was that the printed portion was decolored as it returned to the amorphous state, i.e., it was confirmed that erasure was done.

As discussed above, recording in three colors was possible by altering the way the thermal energy was applied. Note that no deterioration took place even after similar recording and erasure were performed 100 cycles. Note also that no change was found in the printed state even after the medium was left to stand at 30° C. for one year.

Example 22

1.0 part by weight of cyanine as a color former, 1.0 part by weight of diphenyl phosphate as a developer, and 50 parts by weight of methylandrostenediol as a matrix material were blended and thermally melted to yield a homogeneous composition. Note that the color former and the developer used in this example are components which are deprived of a color when the interaction between them increases and develop a color when the interaction decreases. A small amount of the above composition was melted on a 1.5-mm thick glass substrate. A 1-mm glass plate to which a slight amount of silica particles, as spacers, about 10 μm in diameter were adhered was placed on the glass substrate to spread the molten solution on the entire surface of the substrate. The resultant structure was annealed at room temperature. The glass plate was then removed, and it was found that a thin blue amorphous film about 10 μm thick was formed on the glass substrate. Subsequently, a photocurable epoxy resin was coated on the thin amorphous film and optically cured, forming a 1-μm thick protective film. In addition, the entire surface was pressed with a heated roll, and the resultant material was annealed at room temperature, thereby crystallizing the thin amorphous film into a white crystalline substance. In this manner, a recording medium of the present invention was obtained.

Thermal printing was performed on the recording medium with an applied voltage of 15 V and a pulse width of 2 msec by using a thermal head (6 dot/mm, 380 Ω) manufactured by TOSHIBA CORP. As a consequence, the printed portion turned blue as it became amorphous, indicating that positive type recording was performed. Subsequently, the entire surface of the recording medium was pressed by the heated roll, and the medium was left to stand at room temperature. Consequently, the printed portion returned to the white crystalline state, i.e., it was confirmed that erasure was done. No deterioration took place even after similar recording and erasure were performed 100 cycles. Also, no change was found in the printed state even after the medium was left to stand at 30° C. for one year.

Example 23

1.0 part by weight of cyanine as a color former and 5.0 parts by weight of cholesterol phosphate, as a developer, capable of forming an amorphous substance with a glass transition temperature Tg of 25° C. or higher were blended and thermally melted to yield a homogeneous composition. Note that the color former and the developer used in this example are components which are deprived of a color when the interaction between them increases and develop a color when the interaction decreases. A small amount of the above composition was melted on a 1.5-mm thick glass substrate. A 1-mm glass plate to which a slight amount of silica particles, as spacers, about 10 μm in diameter were adhered was placed on the glass substrate to spread the molten solution on the entire surface of the substrate. The resultant structure was annealed at room temperature. The glass plate was then removed, and it was found that a thin colorless amorphous film about 10 μm thick was formed on the glass substrate. Subsequently, a photocurable epoxy resin was coated on the thin amorphous film and optically cured, forming a 1-μm thick protective film. In addition, to return a portion of the thin amorphous film that crystallized during the formation of the protective film to the amorphous state, the entire surface was pressed with a heated roll, and the resultant material was annealed at room temperature. In this manner, a recording medium of the present invention was obtained.

Thermal printing was performed on the recording medium with an applied voltage of 10 V and a pulse width of 1 msec by using a thermal head (6 dot/mm, 380 Ω) manufactured by TOSHIBA CORP. As a consequence, the printed portion turned blue as it became crystalline, indicating that positive type recording was performed. Subsequently, the entire surface of the recording medium was pressed by the heated roll, and the medium was left to stand at room temperature. Consequently, the printed portion returned to the transparent amorphous state, i.e., it was confirmed that erasure was done. No deterioration took place even after similar recording and erasure were performed 100 cycles. Also, no change was found in the printed state even after the medium was left to stand at 30° C. for one year.

Example 24

1.0 part by weight of Crystal Violet lactone as a color former, 1.0 part by weight of ethyl gallate as a developer, 50 parts by weight of methylandrostenediol as a matrix material, and SIR-159 available from Mitsui Toatsu Chemicals Inc. as a near infrared absorbing dye were blended and thermally melted to yield a homogeneous composition. Thereafter, a small amount of the above composition was melted on a 1.2-mm thick glass substrate which was optically polished. A glass plate was then placed on the glass substrate to spread the molten solution on the entire surface of the substrate. Subsequently, the molten solution was cooled by pressing the glass substrate against an aluminum plate which was cooled with water, thereby forming a thin amorphous film about 10 μm thick as a recording layer. In this manner, a recording medium of the present invention constituted by the glass substrate, the recording layer, and the glass plate was manufactured.

While the resultant recording medium was rotated at 900 rpm, a write operation in the recording layer was performed by irradiating a semiconductor laser beam converged into a diameter of 1 μm and having a wavelength of 830 nm such that the intensity on the surface of the recording medium was 2 mW. It was confirmed by observation using a polarizing microscope that the write portion that was irradiated with the laser beam crystallized with a clear contrast. That is, it was found that a line about 1 μm wide was recorded. Subsequently, a semiconductor laser beam converged into a diameter of 2 μm and having a wavelength of 830 nm was so irradiated that the intensity on the surface of the recording medium was 5 mW. When the resultant medium was observed with the polarizing microscope, it was confirmed that the write portion also turned amorphous in the region irradiated with the laser beam with an intensity of 5 mW, demonstrating that erasure was accomplished. Note that no change was found in the write state even after the recording medium was left to stand at 30° C. for one year.

Example 25

1.0 part by weight of Crystal Violet lactone as a color former, 1.0 part by weight of propyl gallate as a developer, and 20 parts by weight of 2-amino-3'-methoxy-dibenzoxadiazole as a matrix material were dissolved in ethanol. The resultant ethanol solution was coated on a 100-μm thick polystyrene film and dried to form a thin amorphous film about 2 μm in thickness. Note that as a result of differential scanning calorimetry, it was confirmed that the 2-amino-3'-methoxy-dibenzoxadiazole in the resultant composition system formed an amorphous substance with a glass transition temperature Tg of 3° C. Subsequently, a 40-μm thick polystyrene film was adhered on the thin amorphous film with heat and pressure. Additionally, in order for the thin film to form a complete amorphous substance, the entire surface was pressed by a heated roll, and the resultant material was quenched. In this manner, a recording medium of the present invention was obtained.

The resultant recording medium was kept in a refrigerator at −10° C. for one month. As a consequence, the colored state remained unchanged, i.e., transparent. Subsequently, the recording medium was exposed to an atmosphere at 5° C. for five minutes. As a result, the entire surface crystallized to change the colored state to blue. This blue colored state remained the same even after the recording medium was returned to the refrigerator, indicating that the temporal atmospheric temperature rise was recorded as information. The entire surface of the recording medium was again pressed by the heated roll, and the medium was quenched. Consequently, the entire surface returned to the transparent amorphous state, so it was confirmed that erasure was performed.

Example 26

1.0 part by weight of Crystal Violet lactone as a color former, 1.0 part by weight of propyl gallate as a developer, 2.0 parts by weight of cholesterol and 10 parts by weight of pregnenolone as reversible materials, 3 parts by weight of a styrene-methacrylic acid copolymer (A91P available from DAINIPPON INK & CHEMICALS INC.) as a polymer compound, and 20% cyclohexane-toluene were placed in a ball mill to yield a uniformly dispersed composition solution. Note that the solubility of each of the color former, the developer, and the reversible materials with respect to 100 g of the styrene-methacrylic acid copolymer was 1 g or less.

The resultant composition solution was coated on a 50-μm polyethyleneterephthalate film by a bar-coating method and dried, thereby forming a recording layer with a film thickness of 5 μm. Subsequently, a 3.0-μm thick polyetheretherketone film on which 0.1-μm thick polystyrene was coated was adhered to the recording layer by using a dry laminate method, forming a protective film. In this manner a recording medium was obtained. The entire surface of the recording medium was pressed by a heated roll, and the medium was cooled to room temperature. Consequently, a colorless, transparent decolored state was obtained. Thermal printing was then performed using a thermal head (8 dot/mm, 1,000 Ω) with an applied voltage of 25 V and a pulse width of 150 μsec. As a result, the printed portion turned blue to indicate that recording was done. Note that between the printed portion and the background the contrast ratio of the transmittance with respect to light having a wavelength of 610 nm was 40. In addition, thermal erasure was carried out for the blue portion with an applied voltage of 25 V and a pulse width of 300 μsec by using the thermal head (8 dot/mm, 1,000 Ω). Consequently, it was confirmed that the blue portion returned to the colorless, transparent decolorized state.

Similar recording and erasure were further performed repetitively, and 1,000 cycles or more were necessary before the contrast ratio was reduced by one-half. Also, no change were found in either the colored or decolored state even after the medium was left to stand at 30° C. for one year.

Example 27

A recording medium was formed following the same procedure as in Example 26 except that polystyrene (HF 77 available from Mitsubishi Kasei Corp.) was used as a polymer compound. Note that the solubilities of the color former, the developer, and the reversible materials with respect to 100 g of the polystyrene were 1 g or less, 1 to 5 g, and 5 to 10 g, respectively. Following the same procedure as in Example 26, printing and erasure tests were performed for the recording medium by using a TPH. Consequently, it was confirmed that both a colored state and a decolored state were attained. Note that between the printed portion and the background, the contrast ratio of the transmittance with respect to light having a wavelength of 610 nm was 48. Similar recording and erasure were further performed repetitively, and 1,000 cycles or more were necessary before the contrast ratio was reduced by one-half. Also, no change were found in either the colored or decolored state even after the medium was left to stand at 30° C. for one year.

Example 28

A recording medium was formed following the same procedure as in Example 26 except that 10 parts by weight of cholesterol and 2 parts by weight of methylandrostenediol were used as reversible materials, polymethylpentene (TPX manufactured by Mitsui Petrochemical Industries Ltd.) was used as a polymer compound, cyclohexane was used as a dispersion solvent, and a polyphenylenesulfide film was used as a film for a protective layer. Note that the solubility of each of the color former, the developer, and the reversible materials with respect to 100 g of polymethylpentene was 5 to 10 g. Following the same procedure as in Example 26, printing and erasure tests were performed for the recording medium by using a TPH. Consequently, it was confirmed that both a colored state and a decolored state were attained. Note that between the printed portion and the background, the contrast ratio of the transmittance with respect to light having a wavelength of 610 nm was 53. Even after similar recording and erasure were further performed repetitively 1,000 cycles, almost no changes was found in the coloring density. Also, no change was found in either the colored or decolorized state even after the recording medium was left to stand at 30° C. for one year.

Example 29

A recording medium of the present invention was formed following the same procedure as in Example 28 except that a fluoran-based leuco compound PSD-V manufactured by Nisso Kako K.K. was used as the color former in place of Crystal Violet lactone. Note that the solubility of the color former with respect to 100 g of a polymer compound was 5 to 10 g. Following the same procedure as in Example 26, printing and erasure tests were performed for the recording medium by using a TPH. Consequently, it was confirmed that both a colored state and a decolored state were attained. Note that between the printed portion and the background, the contrast ratio of the transmittance with respect to light having a maximum absorption wavelength in the colored state was 40. Even after similar recording and erasure were further performed repetitively 1,000 cycles, almost no changes was found in the coloring density. Also, no change was found in either the colored or decolored state even after the recording medium was left to stand at 30° C. for one year.

Example 30

A recording medium was formed following the same procedure as in Example 26 except that polyester (Byron 200 available from TOYOBO CO., LTD.) was used as a polymer compound. Note that the solubilities of the color former, the developer, and the reversible materials with respect to 100 g of the polymer compound were 90 g, 60 g, and 50 g, respectively. Subsequently, the entire surface of the recording medium was pressed by a heated roll, and the medium was cooled to room temperature. Consequently, a colorless, transparent decolored state was obtained. Thermal printing was then performed using a thermal head (8 dot/mm, 1,000 Ω) with an applied voltage of 25 V and a pulse width of 120 μsec. The result was printing in which the coloring density of blue was very low. Furthermore, the recording medium in the decolored state was placed on a hot plate, and a color development test was conducted at several different heating temperatures. As a consequence, only a state in which the coloring density was very low was attained. Note that between the decolored portion and the colored portion, the contrast ratio of the transmittance with respect to light having a wavelength of 610 nm was 1.3.

Example 31

A recording medium was obtained following the same procedure as in Example 28 except that a phenoxy resin (Union Carbide PKHH) was used as a polymer compound. Note that the solubilities of the color former, the developer, and the reversible materials with respect to 100 g of the polymer compound were 60 g, 30 g, and 20 g, respectively. Subsequently, the entire surface of the recording medium was pressed by a heated roll, and the medium was cooled to room temperature. Consequently, a colorless, transparent decolored state was obtained. Thermal printing was then performed using a thermal head (8 dot/mm, 1,000 Ω) with an applied voltage of 25 V and a pulse width of 120 μsec. The result was printing in which the coloring density of blue was very low. Furthermore, the recording medium in the decolored state was placed on a hot plate, and a color development test was conducted at several different heating temperatures. As a consequence, only a state in which the coloring density was very low was attained. Note that between the decolored portion and the colored portion, the contrast ratio of the transmittance with respect to light having a wavelength of 610 nm was 1.2.

Comparing Examples 26 to 29 with Examples 30 and 31 reveals that a high contrast ratio results when the solubility of the color former, the developer, or the reversible material with respect to 100 g of the polymer compound is 10 g or smaller.

Example 32

1.0 part by weight of Crystal Violet lactone as a color former, 1.0 part by weight of propyl gallate as a developer, and 50 parts by weight of methylandrostenediol as a reversible material were blended and thermally melted to yield a homogeneous composition. Neutral paper (SZ base paper manufactured by Daishowa Paper Mfg. Co., Ltd., thickness 25 μm) was impregnated with the resultant composition by heating on a hot plate. The resultant recording medium was heated on the hot plate until the color former, the developer, and the reversible material were melted, and then quenched to room temperature. As a result, a white decolored state was obtained. Subsequently, a blue colored state was attained by heating the recording medium to 60° to 80° C. on the hot plate. The colored state remained unchanged even when the recording medium was annealed to room temperature after the heating. Subsequently, a photocurable epoxy resin was coated on both surfaces of the recording medium and optically cured, thereby forming protective films 1 μm in thickness. Thereafter, the entire surface of the recording medium was pressed by a heated roll, and the medium was annealed to room temperature. Consequently, the recording medium returned to the white decolorized state, indicating that erasure was done. Thermal printing was then performed using a thermal head (8 dot/mm, 1,000 Ω) with an applied voltage of 25 V and a pulse width of 150 μsec. The printed portion turned blue to demonstrate that recording was performed. Note that between the printed portion and the background, the contrast ratio of the reflectance with respect to light having a wavelength of 610 nm was 48. The reported value of the contrast ratio of the leuco dye-long chain phosphonic acid system disclosed in "The 42nd Polymer Forum Preprints", 1993, page 2,736, is at most about 10. This signifies that a display with a very high contrast ratio was accomplished in the present invention. Subsequently, the entire surface of the recording medium was pressed with the heated roll, and the medium was cooled to room temperature. As a consequence, the printed portion returned to the white state, demonstrating that erasure was done. Similar recording and erasure were further performed repetitively, and 1,000 cycles or more were necessary before the contrast ratio was reduced by one-half. Also, no change were found in either the colored or decolored state even after the medium was left to stand at 30° C. for one year.

Example 33

Polyethylene and ethylene-vinyl acetate copolymers with various compositions were used as polymer compounds to check the effect that the content of vinyl acetate (VAc) in the polymer compound had on the coloring characteristics of a recording medium. The results will be described below.

First, 1.0 part by weight of Crystal Violet lactone as a color former, 1.0 part by weight of propyl gallate as a developer, and 10 parts by weight of pregnenolone as a reversible material were blended and thermally melted to yield a homogeneous composition. The resultant composition was dissolved in cyclohexanone, and the solution was dropped on a slide glass and dried, thereby forming a thin film. Each polymer compound was adhered on the thin film by pressure and heated to disperse the composition consisting of the three components described above into the polymer compound. Each resultant sample was heated on a hot plate at 120° C. for 30 min, and the coloring density was qualitatively evaluated. The results are summarized in Table 1. Note that several products different in melt flow rate and having same VAc content were used. In the evaluation results in Table 1, "o" means "the colored state was maintained", "Δ" means "color faded", and "x" means "completely decolored". Table 1 shows the tendency that the coloring density decreases as the VAc content in the ethylene-vinyl acetate copolymer increases.

Separately, 1.0 part by weight of Crystal Violet lactone as a color former and 1.0 part by weight of propyl gallate as a developer were used to perform the same test as above, and the coloring densities were qualitatively evaluated. The results are summarized in Table 2. As is apparent from Table 2, the tendency that the coloring density decreases as the VAc content in the ethylene-vinyl acetate copolymer increases is more significant than in Table 1.

TABLE 1

| VAc content [%] melt flow rate | 0 | 14 | 19 | 25 | 28 | 33 |
|---|---|---|---|---|---|---|
| 2500 | | Δ | | | x | |
| 800 | | | o | | x | |

TABLE 1-continued

| VAc content [%] melt flow rate | 0 | 14 | 19 | 25 | 28 | 33 |
|---|---|---|---|---|---|---|
| 400 | | | o | Δ | x | x |
| 150 | | | | | x | |
| 15 | o | | | | x | x |
| 2 to 4 | o | o | x | x | x | |
| 1 | o | | | | x | x |

TABLE 2

| VAc content [%] melt flow rate | 0 | 14 | 19 | 25 | 28 | 33 |
|---|---|---|---|---|---|---|
| 2500 | | o | | | x | |
| 800 | | | Δ | | x | |
| 400 | | | x | x | x | x |
| 150 | | | | | x | |
| 15 | o | | | | x | x |
| 2 to 4 | o | o | x | x | x | |
| 1 | o | | | | x | x |

Figure 8:
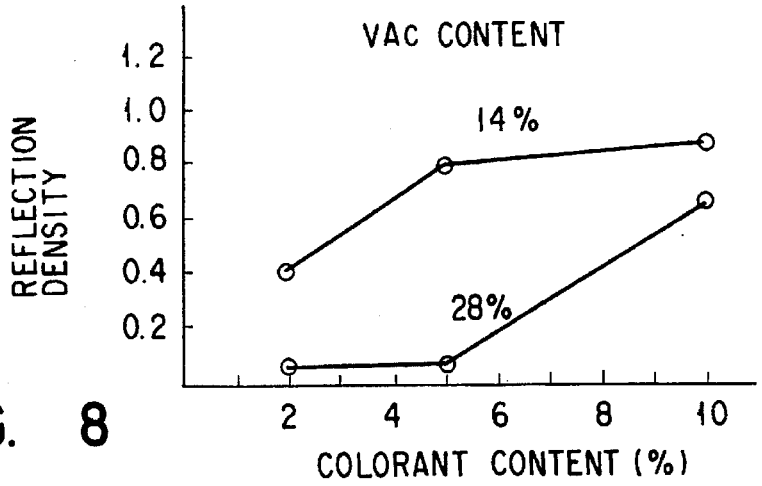
FIG. 8 is a graph showing the relationship between the coloring materials content and the reflection density in a thermal recording medium consisting of a color former, a developer, and an ethylene-vinyl acetate copolymer.

Crystal Violet lactone, propyl gallate, and an ethylene-vinyl acetate copolymer (VAc content 14% or 28%) were dissolved at various composition ratios in a solvent, and the solution was coated on a glass substrate to form a thin film. The reflection density when recording was performed by heating was measured with a Macbeth reflection densitometer. The results are shown in FIG. 8. In FIG. 8, the abscissa indicates the weight ratio of the coloring materials (the color former and the developer) to the total solid content, and the ordinate represents the reflection density. As shown in FIG. 8, the reflection density increases as the VAc content of the ethylene-vinyl acetate copolymer decreases for the same color developing material content. This implies that the vinyl acetate in the ethylene-vinyl acetate copolymer increases the amount of coloring material not contributing to color development.

Figure 9:
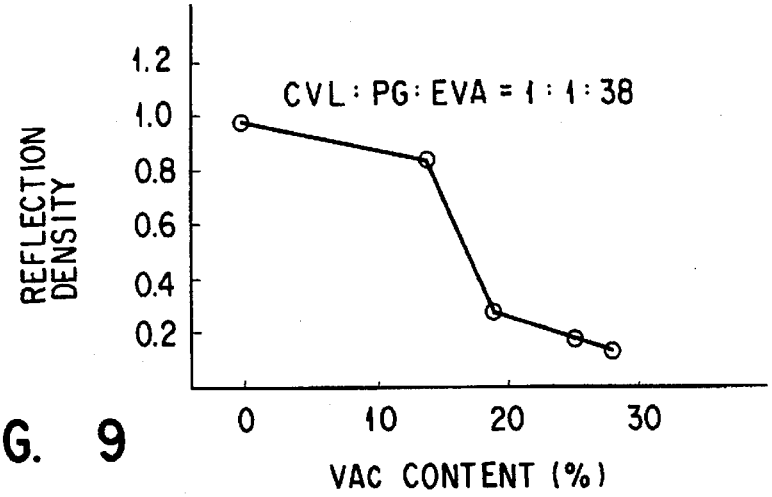
FIG. 9 is a graph showing the relationship between the vinyl acetate content and the reflection density in a thermal recording medium consisting of a color former, a developer, and an ethylene-vinyl acetate copolymer.

FIG. 9 shows the results of examination of the relationship between the VAc content in a copolymer and the reflection density when the weight ratio of the coloring material to the total solid content was fixed. This experiment was performed by using a composition system containing 1.0 part by weight of Crystal Violet lactone as a color former, 1.0 part by weight of propyl gallate as a developer, and 38 parts by weight of an ethylene-vinyl acetate copolymer. As illustrated in FIG. 9, the reflection density decreases with increasing VAc content.

Figure 10:
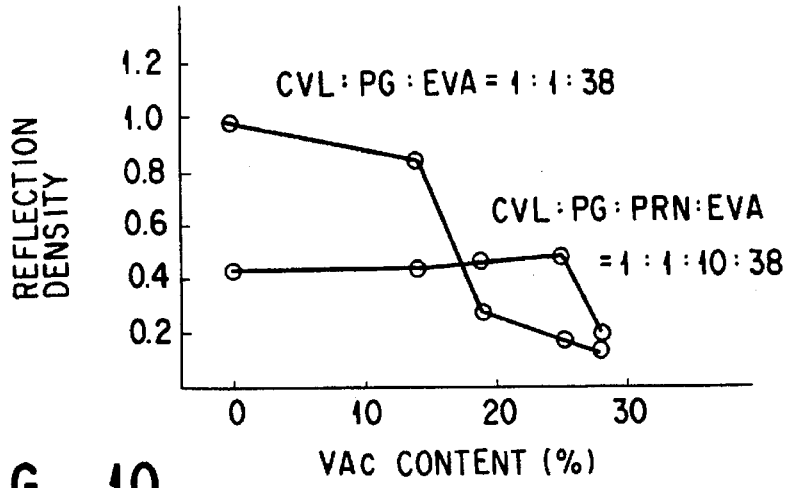
FIG. 10 is a graph showing the relationship between the vinyl acetate content and the reflection density in a thermal recording medium consisting of a color former, a developer, a reversible material, and an ethylene-vinyl acetate copolymer.

A similar experiment was performed using a composition system containing a reversible material. In this experiment, the same measurement as described above was done using a system containing 1.0 part by weight of Crystal Violet lactone as a color former, 1.0 part by weight of propyl gallate as a developer, 10 parts by weight of pregnenolone as a reversible material, and 38 parts by weight of an ethylene-vinyl acetate copolymer. FIG. 10 shows the measurement results. Note that FIG. 10 also shows the results of FIG. 9 (the system containing no reversible material).

Figure 11:
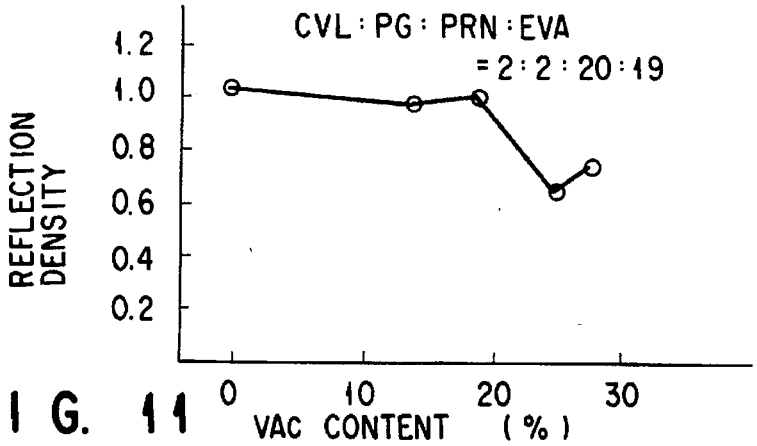
FIG. 11 is a graph showing the relationship between the vinyl acetate content and the reflection density in a thermal recording medium consisting of a color former, a developer, a reversible material, and an ethylene-vinyl acetate copolymer.

From these results, it is evident that in the system containing Crystal Violet lactone as a color former, propyl gallate as a developer, pregnenolone as a reversible material, and an ethylene-vinyl acetate copolymer as a resin, it is necessary to increase the contents of the color former, the developer, and the reversible material relative to the resin in order to obtain a sufficient reflection density. It was found that a practical reflection density of 0.9 or higher was obtained when a resin with a small VAc content was used, e.g., in the composition system containing 4.0 parts by weight of Crystal Violet lactone, 4.0 parts by weight of propyl gallate, 40 parts by weight of pregnenolone, and 38 parts by weight of an ethylene-vinyl acetate copolymer. FIG. 11 illustrates the relationship between the VAc content and the reflection density in this composition system. FIG. 11 shows that the reflection density decreases when the VAc content exceeds 20%. Note that in a composition system in which the weight ratios of the color former and the developer to the resin are high, the reflection density can be kept high over a range within which the VAc content is higher than that described above.

Example 34

Polystrene and styrene-methacrylate acid copolymers with various compositions were used as polymer compounds to check the effect that the content of methacrylate acid in the polymer compound had on the coloring characteristics of a recording medium. The results will be described below.

Figure 12:
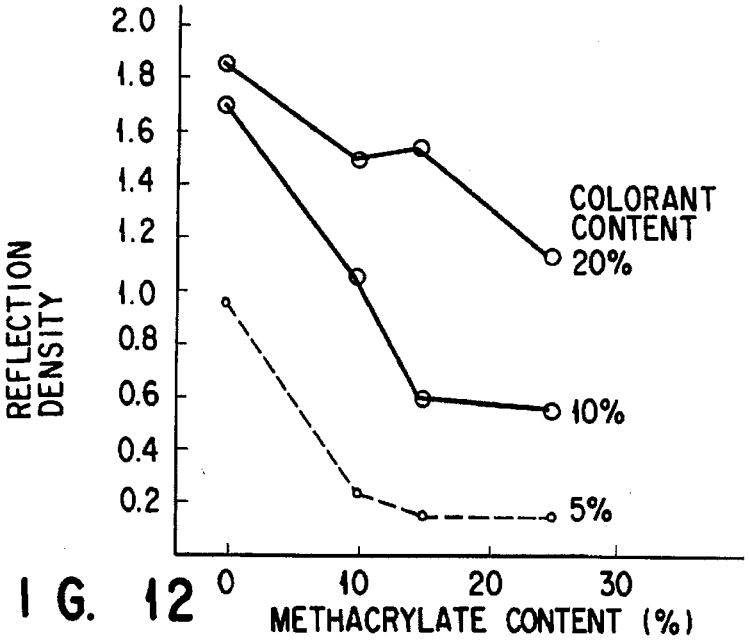
FIG. 12 is a graph showing the relationship between the methacrylate content and the reflection density in a thermal recording medium consisting of a color former, a developer, and a styrene-methacrylic acid copolymer.

Crystal Violet lactone, propyl gallate, and polystyrene or a styrene-methacrylate acid copolymer were dissolved in a solvent, and the solution was coated on a glass substrate to form a thin film. The reflection density when recording was performed by heating was measured with a Macbeth reflection densitometer. FIG. 12 shows the relationship between the methacrylate content in the copolymer and the reflection density. In FIG. 12, the weight ratio of the coloring materials (the color former and the developer) to the total solid content (the coloring materials and the styrene-methacrylate acid copolymer) is used as a parameter.

As shown in FIG. 12, the reflection density decreases as the methacrylate acid content increases. This tendency is more significant than in Example 33 in which an ethylene-vinyl acetate copolymer was used as a resin. It is also evident from FIG. 12 that the reflection density decreases as the weight ratio of the coloring materials to the total solid content decreases.

Figure 13:
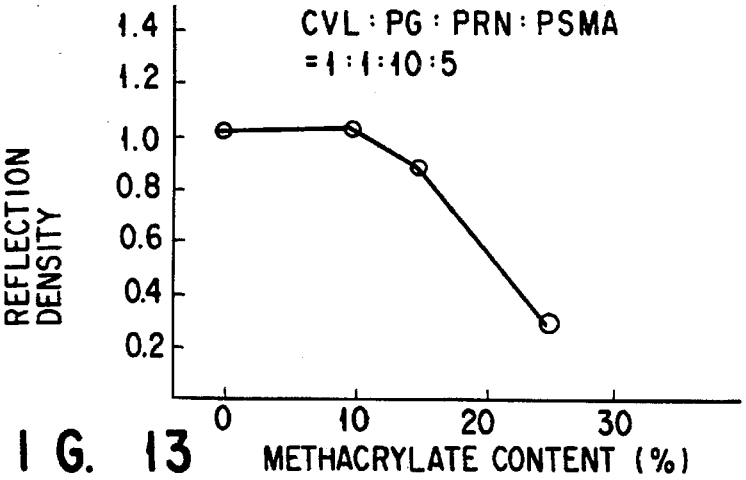
FIG. 13 is a graph showing the relationship between the methacrylate content and the reflection density in a thermal recording medium consisting of a color former, a developer, and a styrene-methacrylic acid copolymer.

A similar tendency is observed in a composition system containing a reversible material as well. It was found that a practical reflection density of 0.9 or higher was obtained when a resin with a small methacrylate acid content was used, e.g., in the composition system containing 1 part by weight of Crystal Violet lactone, 1 part by weight of propyl gallate, 10 parts by weight of pregnenolone, and 5 parts by weight of a styrene-methacrylate copolymer. The ratio of the coloring materials required to obtain this practical color development was higher than that in Example 33. FIG. 13 illustrates the relationship between the methacrylate content and the reflection density in this composition system. FIG. 13 shows that the reflection density decreases when the methacrylate content exceeds 15%. Note that in a composition system in which the weight ratios of the color former and the developer to the resin are high, the reflection density can be kept high over a range within which the methacrylate content is higher than described above.

Example 35

1.0 part by weight of Crystal Violet lactone as a color former, 1.0 part by weight of propyl gallate as a developer, 10 parts by weight of pregnenolone as a matrix material, and 20 parts by weight of polyethersulfone as a polymer compound were homogeneously mixed and thermally melted. The resultant molten mixture was evenly spread on a 1.5-mm thick glass substrate and annealed. Consequently, a homogeneous thin amorphous film with a film thickness of about 10 μm was formed on the glass substrate. Additionally, to return a portion of the thin amorphous film that crystallized during the formation to the amorphous state, the entire surface of the thin film was pressed with a heated roll. The film was then annealed at room temperature to form a uniform, transparent film. In this manner, a recording medium of this example was obtained.

Figure 14:
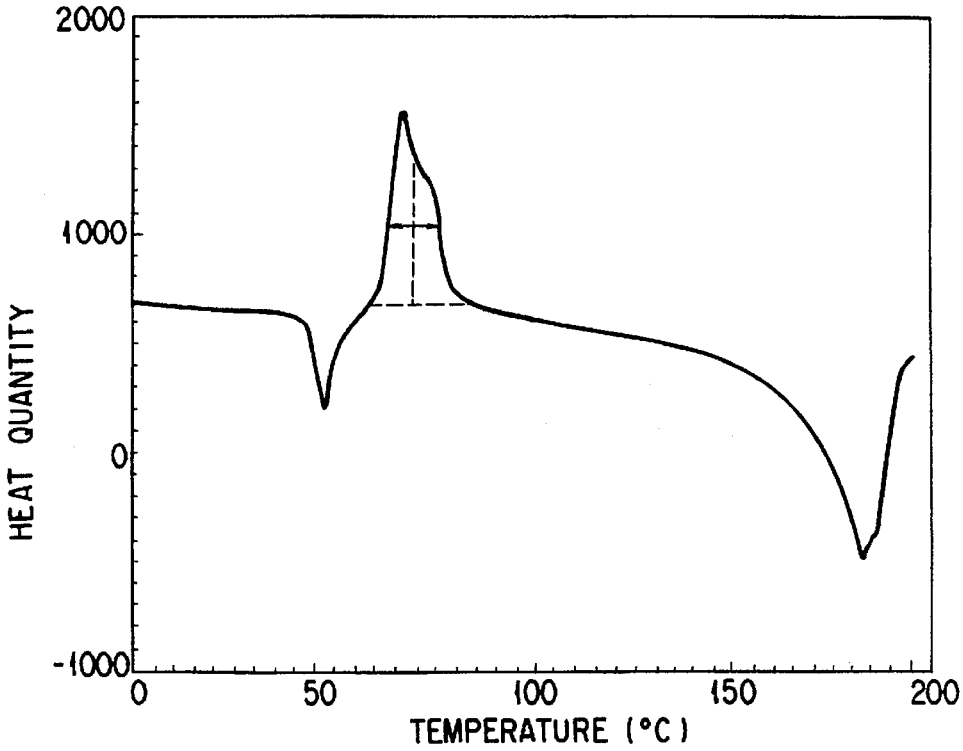
FIG. 14 is a graph showing the DSC measurement result of a thermal recording medium of a three-component system consisting of a color former, a developer, and a reversible material.
Figure 15:
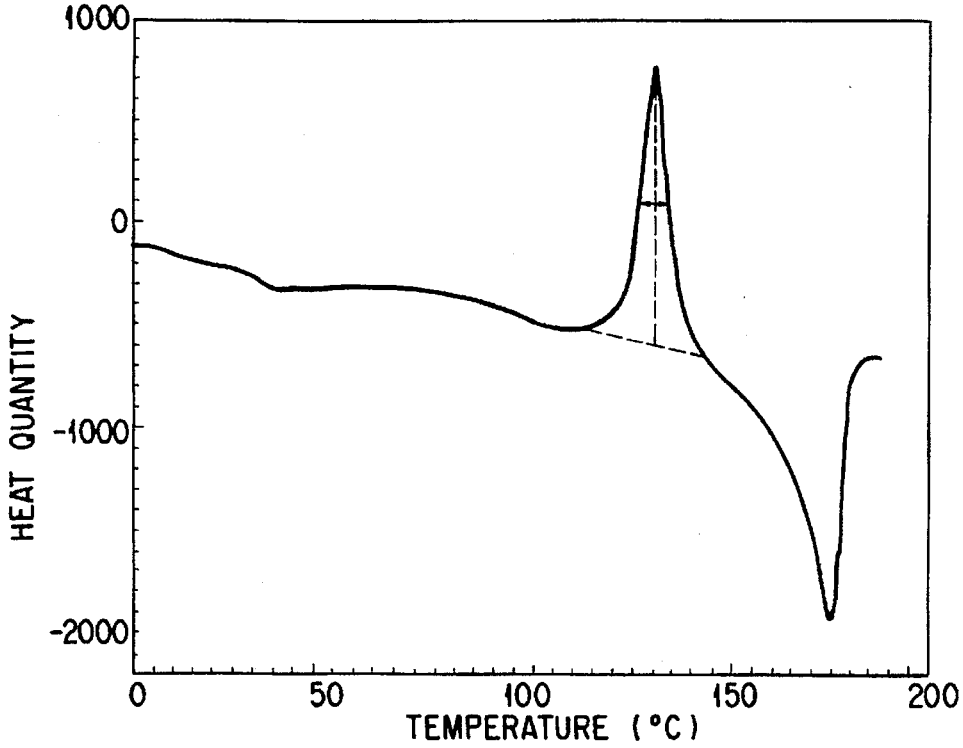
FIG. 15 is a graph showing the DSC measurement result of a recording medium in which a three-component system consisting of a color former, a developer, and a reversible material is dispersed in polyethersulfone.

The results of differential scanning calorimetry were as follows. That is, the Crystal Violet lactone had a glass transition temperature Tg of 73° C. and formed a stable amorphous substance at room temperature. The propyl gallate formed no stable amorphous substance because it were highly crystallizable. The glass transition temperature Tg of the polyethersulfone was 215° C. FIG. 14 shows the results of differential scanning calorimetry (DSC) performed for the three-component system consisting of the color former, the developer, and the matrix material. From FIG. 14, it is apparent that this three-component system of the color former, the developer, and the matrix material had a glass transition temperature Tg of 44° C., formed a stable amorphous substance at room temperature, had a crystallization temperature of 65° to 75° C., and had a melting point of 184° C. FIG. 15 shows the results of DSC performed for the recording medium of this example. It is evident from FIG. 15 that the three-component system consisting of the color former, the developer, and the matrix material and dispersed in the polyethersulfone formed a stable amorphous substance with a glass transition temperature Tg of 29° C., and had a crystallization temperature of 130° C. and a melting point of 175° C. This implies that the crystallization temperature rises greatly when the three-component system is dispersed in polyethersulfone.

Thermal printing was performed for the resultant recording medium with an applied voltage of 14 V and a pulse width of 1 msec by using a thermal head (6 dot/mm, 380 Ω) manufactured by TOSHIBA CORP. Consequently, the printed portion crystallized to turn blue, indicating that positive type printing was performed. Also, even when the pulse width was changed to 0.5 msec, positive type recording was done in precisely the same fashion as described above. On the other hand, no practical-level recording was possible when the pulse width was below 1 msec in the three-component system of the color former, the developer, and the matrix material. This demonstrates that the printing rate can be increased by the use of a recording medium in which the three components, the color former, the developer, and the matrix material, are dispersed in polyethersulfone.

This increase in the printing rate rests upon an increase in the rate of an amorphous-to-crystalline transition. It is known that the rate of an amorphous-to-crystalline transition increases as the full width at half maximum (FWHM) of the transition peak in a DSC chart decreases. Actually, in FIG. 15 the FWHM of the transition peak is about ½ that in FIG. 14. This indicates that the rate of an amorphous-to-crystalline transition was increased.

Subsequently, the entire surface of the recording medium was pressed by the heated roll, and the medium was left to stand at room temperature. As a consequence, the printed portion turned colorless and transparent as it became amorphous, indicating that erasure was done. Note that no deterioration took place even after similar recording and erasure were performed 100 cycles. Note also that no change was found in the printed state even after the medium was left to stand at 30° C. for one year.

Example 36

A recording medium was formed following the same procedure as in Example 35 except that 10 parts by weight of a styrene-methyl methacrylate random copolymer (to be abbreviated S-MMA hereinafter) were used as a polymer compound in place of polyethersulfone.

Figure 16:
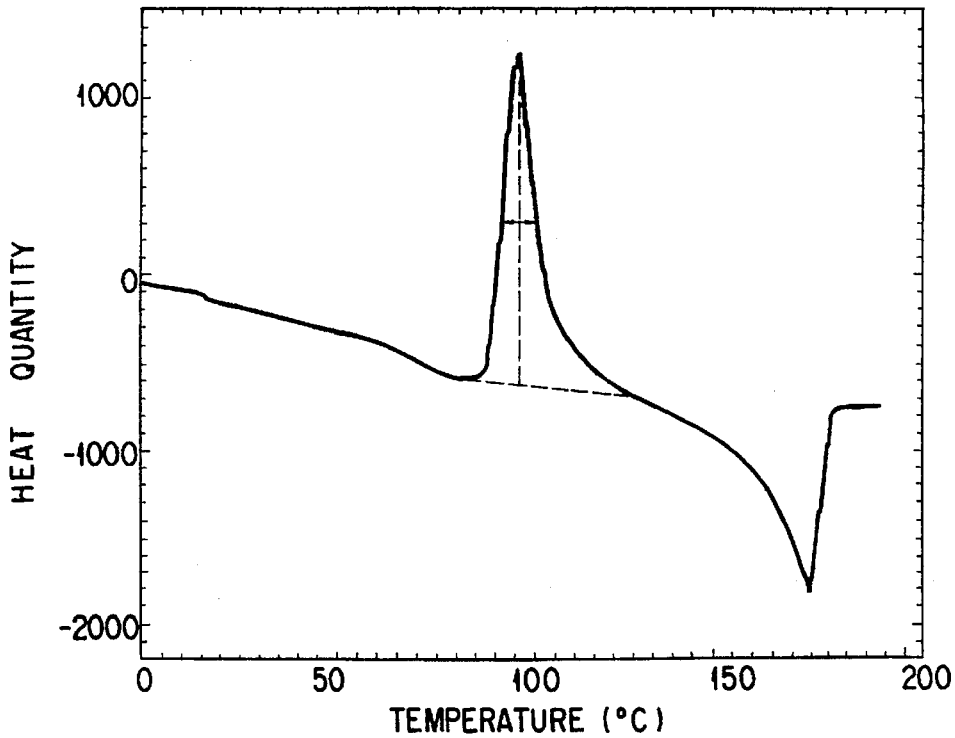
FIG. 16 is a graph showing the DSC measurement result of a recording medium in which a three-component system consisting of a color former, a developer, and a reversible material is dispersed in a styrene-MMA copolymer.

Note it was found by DSC that the glass transition temperature Tg of the S-MMA was 125° C. FIG. 16 shows the results of DSC performed for the recording medium of this example. FIG. 16 reveals that the three-component system consisting of a color former, a developer, and a matrix material and dispersed in the S-MMA formed a stable amorphous substance with a glass transition temperature Tg of 60° C., and had a crystallization temperature of 96° C. and a melting point of 171° C. As can be seen by comparing FIGS. 16 and 14, when the three-component system of the color former, the developer, and the matrix material was dispersed in the S-MMA, the crystallization temperature rose by about 30° C., and the FWHM of the transition peak was reduced by about ½, thereby increasing the rate of an amorphous-to-crystalline transition.

Thermal printing was performed for the resultant recording medium with an applied voltage of 10 V and a pulse width of 0.5 msec by using a thermal head (6 dot/mm, 380 Ω) manufactured by TOSHIBA CORP. Consequently, the printed portion crystallized to turn blue, indicating that positive type printing was performed. This made it possible to increase the printing rate. Subsequently, the entire surface of the recording medium was pressed by a heated roll, and the medium was left to stand at room temperature. As a consequence, the printed portion turned colorless and transparent as it became amorphous, indicating that erasure was done. Note that no deterioration took place even after similar recording and erasure were performed 100 cycles. Note also that no change was found in the printed state even after the medium was left to stand at 30° C. for one year.

Example 37

A recording medium was formed following the same procedure as in Example 35 except that 10 parts by weight of polyethyleneisophthalate were used as a polymer compound in place of polyethersulfone.

Figure 17:
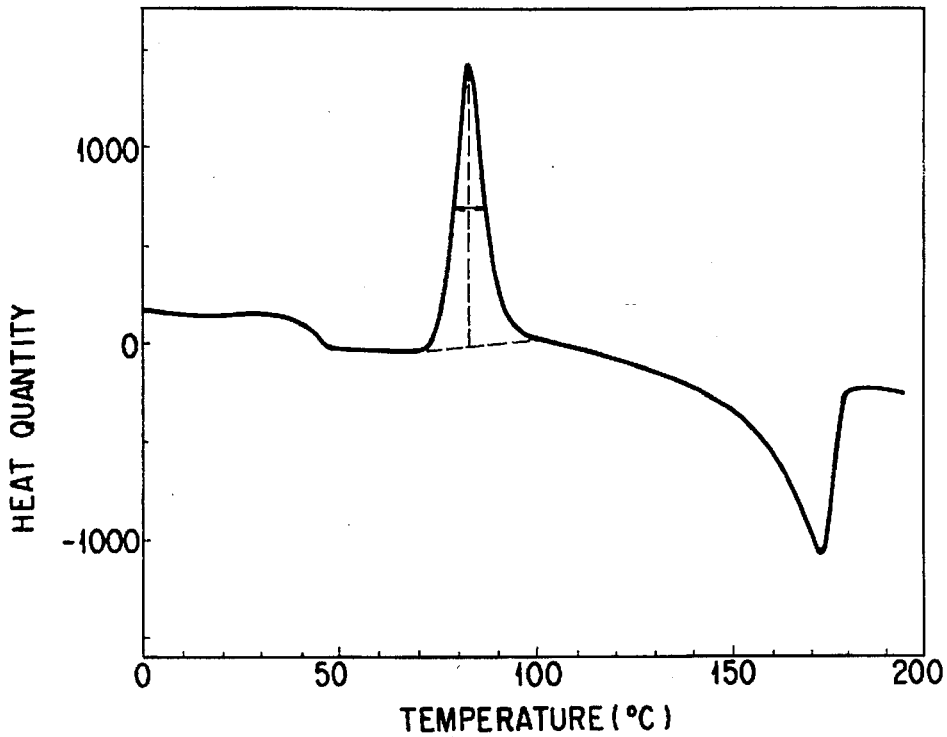
FIG. 17 is a graph showing the DSC measurement result of a recording medium in which a three-component system consisting of a color former, a developer, and a reversible material is dispersed in polyethyleneisophthalate.

Note it was found by DSC that the glass transition temperature Tg of the polyethyleneisophthalate was 65° C. FIG. 17 shows the results of DSC performed for the recording medium of this example. FIG. 17 reveals that the three-component system consisting of a color former, a developer, and a matrix material and dispersed in the polyethylenephthalate formed a stable amorphous substance with a glass transition temperature Tg of 43° C., and had a crystallization temperature of 84° C. and a melting point of 174° C. As can be seen by comparing FIGS. 17 and 14, when the three-component system of the color former, the developer, and the matrix material was dispersed in the polyethylenephthalate, the crystallization temperature rose by about 15° C., and the FWHM of the transition peak was reduced by about ½, thereby increasing the rate of an amorphous-to-crystalline transition.

Thermal printing was performed for the resultant recording medium with an applied voltage of 9 V and a pulse width of 0.5 msec by using a thermal head (6 dot/mm, 380 Ω) manufactured by TOSHIBA CORP. Consequently, the printed portion crystallized to turn blue, indicating that positive type printing was performed. This made it possible to increase the printing rate. Subsequently, the entire surface of the recording medium was pressed by a heated roll, and the medium was left to stand at room temperature. As a consequence, the printed portion turned colorless and transparent as it became amorphous, indicating that erasure was done. Note that no deterioration took place even after similar recording and erasure were performed 100 cycles. Note also that no change was found in the printed state even after the medium was left to stand at 30° C. for one year.

Example 38

Figure 18:
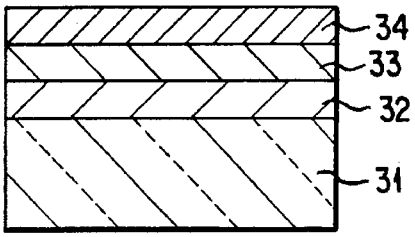
FIG. 18 is a longitudinal sectional view showing still another example of the recording medium of the present invention.

A recording medium illustrated in FIG. 18 was manufactured by using the composition X in Example 35, the composition Y in Example 36, and the composition Z in Example 37. This recording medium was manufactured by sequentially forming, on a 1.5-mm glass substrate 31, a first recording layer 32 made from the composition X, a second recording layer 33 made from the composition Y, and a third recording layer 34 made from the composition Z. Each recording layer was formed by thermally melting a homogeneous mixture of the corresponding composition, evenly spreading the molten mixture on the underlying layer, and cooling the resultant film. The film thickness of each layer was about 5 μm.

Thermal printing was performed on the recording medium with an applied voltage of 9 V and a pulse width of 0.5 msec by using a thermal head (6 dot/mm, 380 Ω) manufactured by TOSHIBA CORP. As a consequence, the printed portion crystallized to turn blue, indicating that positive type recording was performed. Subsequently, thermal printing was performed with an applied voltage of 10 V and a pulse width of 0.5 msec. As a result, the printed portion crystallized to turn blue to indicate that positive type recording was performed. Thermal printing was also done with an applied voltage of 14 V and a pulse width of 0.5 msec. Consequently, the printed portion turned blue as it crystallized, demonstrating that positive type recording was performed. In the printed portions obtained with applied voltages of 9, 10, and 14 V, the peak absorbances with respect to light having a wavelength of 610 nm were found to be 0.9, 2.2, and 3.0, respectively. That is, the printed portions having three different absorbances corresponding the respective applied voltages were obtained. Subsequently, the entire surface of the recording medium was pressed by a heated roll, and the medium was left to stand at room temperature. Consequently, the printed portion turned colorless and transparent as it became amorphous, i.e., it was confirmed that erasure was done.

Example 39

A composition Y' was prepared by using 1.0 part by weight of PSD-HR manufactured by Nippon Soda Co., Ltd. in place of Crystal Violet lactone, the color former, used in the composition Y of Example 36. Also, a composition Z' was prepared by using 1.0 part by weight of Y-1 available from Yamamoto Kasei K.K. in place of Crystal Violet lactone, the color former, used in the composition Z of Example 37. A recording medium shown in FIG. 18 was manufactured following the same procedure as in Example 38 by using the composition X of Example 35 and the compositions Y' and Z'.

Thermal printing was performed on the recording medium with an applied voltage of 9 V and a pulse width of 1 msec by using a thermal head (6 dot/mm, 380 Ω) manufactured by TOSHIBA CORP. As a consequence, the printed portion turned yellow upon crystallization, indicating that positive type recording was performed. Subsequently, thermal printing was performed with an applied voltage of 9 V and a pulse width of 0.5 msec. Then, the printed portion turned orange upon crystallization to indicate that positive type recording was done. Subsequently, thermal printing was performed with an applied voltage of 10 V and a pulse width of 0.5 msec, and the printed portion crystallized to turn blue to indicate that positive printing was performed. Thermal printing was also done with an applied voltage of 14 V and a pulse width of 0.5 msec. Consequently, the printed portion turned black as it crystallized, demonstrating that positive type recording was performed. In this manner, the printed portions having three different colors, orange, blue, and black, were obtained in accordance with the applied voltages (9, 10, and 14 V). Subsequently, the entire surface of the recording medium was pressed by a heated roll, and the medium was left to stand at room temperature. Consequently, the printed portion turned colorless and transparent as it became amorphous, i.e., it was confirmed that erasure was done.

Example 40

1.0 part by weight of Crystal Violet lactone as a color former, 1.0 part by weight of propyl gallate as a developer, 5 parts by weight of pregnenolone as a reversible material, and 5 parts by weight of 1-docosanol as a phase separation controller were blended, heated, and melt-mixed to yield a homogeneous composition. The resultant composition was sandwiched between glass plates on a hot plate while the amount of the composition was so adjusted that the thickness was about 5 μm, thereby forming a measurement sample.

Figure 19:
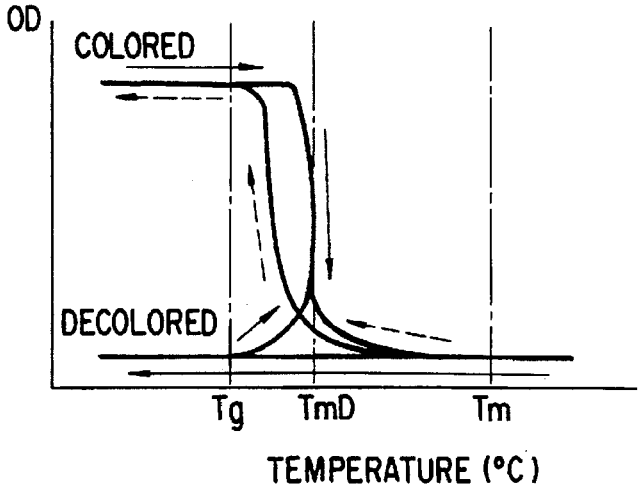
FIG. 19 is a graph showing the relationship between the temperature and the optical density of still another example of the recording medium of the present invention.

This composition exhibits typical four-component coloring characteristics. The characteristics of this example are shown in FIG. 19, and the relationship between the thermal history and the coloring density (OD) will be described below with reference to FIG. 19. In FIG. 19, the temperature is plotted on the ordinate, and the reflection density with respect to light having a wavelength of 610 nm is plotted on the abscissa.

At room temperature (Trt), the colored state in which the phase of Crystal Violet lactone and propyl gallate, the phase of pregnenolone, and the phase of 1-docosanol are phase separated is close to an equilibrium in respect of the solubilities.

When the composition system is heated from this state to a melting point (Tm: about 150° C. in this composition) or higher, the propyl gallate ceases to interact with the Crystal Violet lactone and simultaneously commences to interact with the pregnenolone in a flowable state. As a result, at the melting point or higher temperatures the system loses its color.

When the system is cooled from the molten state, a miscible mixture of the pregnenolone and the 1-docosanol forms a supercooled liquid which maintains the flowability even at temperatures lower than the melting point. Consequently, the propyl gallate and the pregnenolone in a flowable state solidify at low temperatures below the glass transition point Tg while maintaining an interaction between them. The pregnenolone forms an amorphous substance as it incorporates the propyl gallate in excess of the equilibrium solubility, resulting in a colorless nonequilibrium state. Therefore, in this four-component system a colorless nonequilibrium state can be obtained by either quenching or annealing. Even an amorphous substance in a nonequilibrium state of the four-component system has a long life at temperatures below the glass transition point Tg (approximately 36° C. in this composition). If the room temperature is below Tg, therefore, this nonequilibrium state does not easily transit to an equilibrium state.

When the amorphous substance in a nonequilibrium state of the four-component system is heated to a temperature higher than the glass transition point, the diffusion rate of the developer in the system increases abruptly. Consequently, the phase separation between the propyl gallate and the pregnenolone is accelerated in the direction in which the nonequilibrium state returns to the equilibrium state, and so the reflection density of the sample increases with increasing temperature. However, when the temperature becomes close to the melting point TmD (approximately 69° C. for 1-docosanol) of the phase separation controller, the liquefied 1-docosanol dissolves the propyl gallate and a portion of the pregnenolone. In this case, it is believed that the solubilities of propyl gallate and pregnenolone to 1-docosanol as the phase separation controller are relatively high. This dramatically accelerates the phase separation between the propyl gallate and the pregnenolone. At the same time, the liquefied 1-docosanol abruptly reduces the interaction between the propyl gallate and the Crystal Violet lactone. As a result, the system is rendered opaque, i.e., nearly loses its color.

When the temperature of the system is again decreased from this state to the solidification point or lower, the solubility of the propyl gallate to the 1-docosanol abruptly decreases upon the solidification. This instantaneously separates the phases of the propyl gallate and the 1-docosanol. The propyl gallate thus phase-separated again interacts with the Crystal Violet lactone, and the system is set in a stabler colored state closer to the equilibrium state. The coloring rate of the composition system containing the phase separation controller brings about a two to three orders of magnitude change between room temperature and the glass transition point, and again causes a three to five orders of magnitude change between the glass transition point and the melting point of the phase separation controller. Therefore, in the four-component system an equilibrium-to-nonequilibrium phase change can be reversibly repeated at an extremely high rate by properly supplying thermal energies with two different values capable of heating up to the melting point Tm of the system and the melting point TmD of the phase separation controller. This makes it possible to repetitively obtain colored and decolored states regardless of whether the thermal history is quenching or annealing.

Examples of the material of the phase separation controller exhibiting the coloring characteristics analogous to those of 1-docosanol are straight-chain higher monovalent alcohols such as stearyl alcohol, 1-eicosanol, 1-tetracosanol, 1-hexacosanol, and 1-octacosanol; straight-chain higher polyvalent alcohols such as 1,10-decanediol, 1,12-dodecanediol, 1,12-octadecanediol, 1,2-dodecanediol, 1,2-tetradecanediol, and 1,2-hexadecanediol; and straight-chain higher fatty acid alcohol amides such as isopropanolamide stearate and isopropanolamide behenate. It is found from the experimental results that the coloring characteristics as in this example are generally obtained when a low-molecular organic substance having a long-straight-chain alcohol group is used as the phase separation controller. In contrast, alcohols having a short straight chain, such as 1,6-hexanediol, and alicyclic alcohols having no long straight chain, such as 1,4-cyclohexanediol, trans-1,2-cyclohexanediol, and cyclododecanol, are unsuitable as the material of the phase separation controller, because of poor color development characteristics of these substances.

Figure 20:
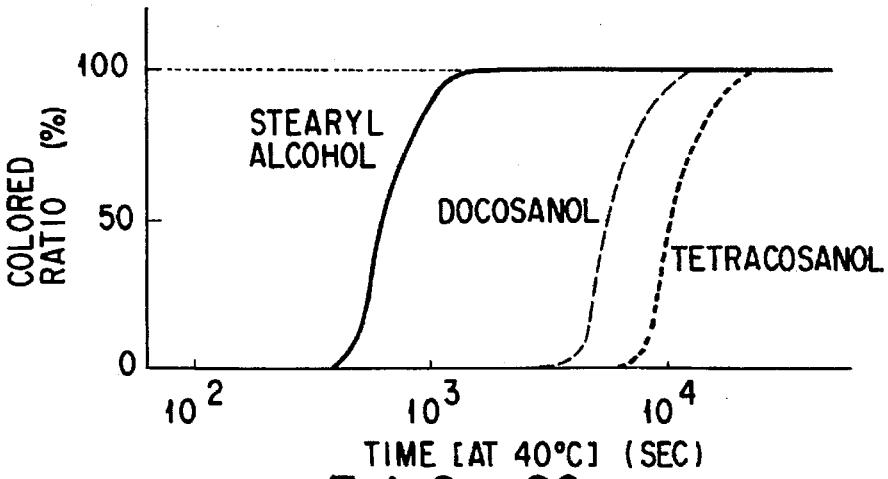
FIG. 20 is a graph showing the relationships between the storage time and the colored ratio of recording media using various phase separation controllers.

FIG. 20 shows the storage stability obtained when higher polyvalent alcohols different in the length of a straight chain were chosen as the phase separation controller at the composition ratio of this example. With reference to FIG. 20, the relationship between the length of the straight chain (and the melting point) of the phase separation controller and the storage stability will be described below. In FIG. 20, the logarithm of time is plotted on the abscissa, and the coloring ratio is plotted on the ordinate. The data depicted in FIG. 20 were obtained from stearyl alcohol ($C_{18}H_{37}OH$, melting point 59° C.), 1-docosanol ($C_{22}H_{45}OH$, melting point 69° C.), and 1-tetracosanol ($C_{24}H_{49}OH$, melting point 74° C.) chosen as higher alcohols for the phase separation controller. As is apparent from FIG. 20, the storage stability in a colorless state of stearyl alcohol is about 9 times lower than that of 1-docosanol, and about 20 times lower than that of 1-tetracosanol. As indicated by these examples of long-straight-chain alcohols, the length of the straight chain and the melting point of the phase separation controller are important factors which determine the storage stability.

Note that factors which largely change the storage stability of a sample, other than the length of the straight chain or the melting point of the phase separation controller, are the glass transition temperatures of the developer and the reversible material. That is, the higher the glass transition point, the longer the life.

Example 41

Figure 21:
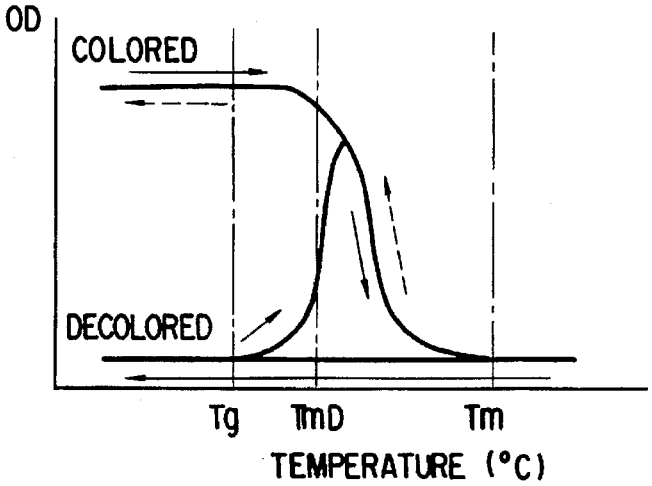
FIG. 21 is a graph showing the relationship between the temperature and the optical density of still another example of the recording medium of the present invention.

A measurement sample was formed following the same procedure as in Example 40 except that 2.5 parts by weight of behenic acid were used as a phase separation controller. The coloring characteristics of this example are illustrated in FIG. 21, and the relationship between the thermal history and the optical density (OD) will be described below with reference to FIG. 21.

At room temperature (Trt), the colored state in which the phase of Crystal Violet lactone and propyl gallate, the phase of pregnenolone, and the phase of behenic acid are phase separated is close to an equilibrium in respect of the solubilities. When the composition system is heated from this state to a melting point Tm (about 160° C. in this composition) or higher, the propyl gallate ceases to interact with the Crystal Violet lactone and simultaneously commences to interact with the pregnenolone in a flowable state. As a result, at the melting point or higher temperatures the system loses its color.

When the system is cooled from the molten state, a miscible mixture of the pregnenolone and the behenic acid forms a supercooled liquid which maintains the flowability even at temperatures lower than the melting point. Consequently, the propyl gallate and the pregnenolone in a flowable state solidify at low temperatures below the glass transition point Tg while maintaining an interaction between them. The pregnenolone forms an amorphous substance as it incorporates the propyl gallate in excess of the equilibrium solubility, resulting in a colorless nonequilibrium state. Even an amorphous substance in a nonequilibrium state of the four-component system has a long life at temperatures below the glass transition point Tg (approximately 39° C. in this composition). If the room temperature is below Tg, therefore, this nonequilibrium state does not easily transit to an equilibrium state.

When the amorphous substance is heated to a temperature higher than the glass transition point, the diffusion rate of the developer in the system increases abruptly. Consequently, the phase separation between the propyl gallate and the pregnenolone is accelerated in the direction in which the nonequilibrium state returns to the equilibrium state, and so the reflection density of the sample increases with increasing temperature.

When the temperature becomes close to the melting point TmD (approximately 80° C. for behenic acid) of the phase separation controller, the liquefied behenic acid dissolves the propyl gallate and a portion of the pregnenolone. This dramatically accelerates the phase separation between the propyl gallate and the pregnenolone. At the same time, the reflection density of the sample abruptly increases. It is considered that behenic acid and 1-docosanol differ in the relationship between the reflection density and the temperature history due to the different interactions between these phase separation controllers and propyl gallate. That is, the solubility of pregnenolone to behenic acid is very low, therefore, Crystal Violet lactone and propyl gallate interact somewhat with each other even at temperatures above the melting point TmD of behenic acid.

When the temperature of the system is again decreased from this state to the solidification point or lower, the solubility of the propyl gallate to the behenic acid abruptly decreases upon solidification. This instantaneously separates the phases of the propyl gallate and the behenic acid. The propyl gallate thus phase-separated again interacts with the Crystal Violet lactone, and the system is set in a dense colored state closer to an equilibrium state. The coloring rate of the composition system containing the phase separation controller brings about a two to three orders of magnitude change between room temperature and the glass transition point, and again causes a two to three orders of magnitude change between the glass transition point and the melting point. It is considered that behenic acid and 1-docosanol differ somewhat from each other in the reaction rate due to the different solubilities of these phase separation controllers with respect to propyl gallate. In the four-component system of this example, as in the four-component system of the above example, an equilibrium-to-nonequilibrium phase change can be reversibly repeated at an extremely high rate by properly supplying thermal energies with two different values capable of heating up to the melting point Tm of the system and the melting point TmD of the phase separation controller. This makes it possible to repetitively obtain colored and decolored states regardless of whether the thermal history is quenching or annealing.

Examples of the material of the phase separation controller exhibiting color development characteristics similar to those of behenic acid are straight-chain higher fatty acids such as palmitic acid, stearic acid, 1-octadecanoic acid, behenic acid, 1-docosanoic acid, 1-tetracosanoic acid, 1-hexacosanoic acid, and 1-octacosanoic acid; straight-chain higher polyvalent fatty acids such as sebacic acid, and 1,12-dodecanedicarboxylic acid; straight-chain higher ketones such as 14-heptacosanone and stearone; straight-chain higher fatty acid diol diesters such as ethyleneglycol distearate, propyleneglycol distearate, butyleneglycol distearate, catechol distearate, cyclohexanediol distearate, ethyleneglycol dibehenate, propyleneglycol dibehenate, butyleneglycol dibehenate, catechol dibehenate, and cyclohexanediol diester behenate; and ester wax, alcohol wax, and urethane wax. It is found from the experimental results that the coloring characteristics as in this example are generally obtained when a low-molecular organic substance having a long-straight-chain carboxylic acid or carboxyl group is used as the phase separation controller. In contrast, a fatty acid having a short straight chain, such as lauric acid, is unsuitable as the material of the phase separation controller, since it is difficult for this acid to fix the transparent state. Paraffin wax is also inadequate as the material of the phase separation controller because the contrast between coloring and decoloring is lower than those obtained by other substances. In addition, the optical density in the decolored state when a phase separation controller having long-straight-chain carboxylic acid is used is slightly different from that obtained in a system using long-straight-chain alcohol as a phase separation controller. The reason for this is assumed that protons are supplied from a portion of the carboxylic acid, and these protons cause to develop a color.

Example 42

1.0 part by weight of Crystal Violet lactone as a color former, 1.0 part by weight of 2,2',4,4'-tetrahydroxybenzophenone as a developer, 3.5 parts by weight of methylandrostenediol as a reversible material, and 5 parts by weight of 1-tetracosanol as a phase separation controller were blended, heated, and melt-mixed to yield a homogeneous composition. The resultant composition was sandwiched between glass plates on a hot plate while the amount of the composition was so adjusted that the thickness was about 5 μm, thereby forming a measurement sample. The sample with this composition was excellent in both the coloring and decoloring speeds; coloring and decoloring were possible within 0.3 sec. The sample also had practical performance in the storage stability. That is, as a result of a 40° C. storage stability test, the coloring ratio after an elapse of 24 hours was found to be 10% or lower.

Example 43

1.0 part by weight of Crystal Violet lactone as a color former, 1.0 part by weight of 2,3,4,4'-tetrahydroxybenzophenone as a developer, 5 parts by weight of pregnenolone as a reversible material, and 5 parts by weight of 1-docosanol as a phase separation controller were blended, heated, and melt-mixed to yield a homogeneous composition. The resultant composition was sandwiched between glass plates on a hot plate while the amount of the composition was so adjusted that the thickness was about 5 μm, thereby forming a measurement sample. The sample with this composition was excellent in both the coloring and decoloring speeds; coloring and decoloring were possible within 0.3 sec. The sample also had practical performance in the storage stability. That is, as a result of a 40° C. storage stability test, the coloring ratio after an elapse of 24 hours was found to be 10% or lower.

Example 44

1.0 part by weight of Crystal Violet lactone as a color former, 1.0 part by weight of 2,3,4,4'-tetrahydroxybenzophenone as a developer, 5 parts by weight of methylandrostenediol as a reversible material, and 5 parts by weight of 1-docosanol as a phase separation controller were blended, heated, and melt-mixed to yield a homogeneous composition. The resultant composition was sandwiched between glass plates on a hot plate while the amount of the composition was so adjusted that the thickness was about 5 μm, thereby forming a measurement sample. The sample with this composition was excellent in both the coloring and decoloring speeds; coloring and decoloring were possible within 0.3 sec. The sample also had practical performance in the storage stability. That is, as a result of a 40° C. storage stability test, the coloring ratio after an elapse of 100 hours was found to be 10% or lower.

Example 45

1.0 part by weight of Crystal Violet lactone as a color former, 1.0 part by weight of propyl gallate as a developer, 3.5 parts by weight of methylandrostenediol as a reversible material, and 2.5 parts by weight of 1,12-dodecanecarboxylic acid as a phase separation controller were blended, heated, and melt-mixed to yield a homogeneous composition. The resultant composition was sandwiched between glass plates on a hot plate while the amount of the composition was so adjusted that the thickness was about 5 μm, thereby forming a measurement sample. The sample with this composition was excellent in both the coloring and decoloring speeds; coloring and decoloring were possible within 0.5 sec. The sample also had practical performance in the storage stability. That is, as a result of a 40° C. storage stability test, the coloring ratio after an elapse of 100 hours was found to be 10% or lower.

Example 46

Neutral paper (SZ base paper manufactured by Daishowa Paper Mfg. Co., Ltd., thickness 25 μm) was impregnated with the composition of Example 42 by heating on a hot plate. A film of the resultant recording medium was heated on the hot plate until a color former, a developer, and a reversible material were melted, and then cooled to room temperature. As a result, a white decolored state was obtained. Subsequently, a light blue state was attained by heating the recording medium to 90° C. on the hot plate. The sample showed a dense colored state when it was annealed to room temperature after the heating. Subsequently, a photocurable epoxy resin was coated on both surfaces of the recording medium and optically cured, thereby forming protective films 1 μm in thickness.

Using this sample it was possible to repetitively perform coloring and decoloring within about 0.3 sec, respectively, at a decoloring set temperature of 180° C. and a coloring set temperature of 100° C. in accordance with a hot stamp method. Similar recording and erasure were further performed repetitively, and 100 cycles or more were necessary before the contrast ratio was reduced by one-half.

Example 47

The composition of Example 40, 2 parts by weight of a styrene-methacrylate copolymer (A37P available from DAINIPPON INK & CHEMICALS INC.) as a polymer compound, and a 20% cyclohexane-toluene solvent as a dispersion solvent were dispersed in a ball mill to yield a uniformly dispersed composition solution. Note that the solubility of each of a color former, a developer, and a reversible material with respect to 100 g of the styrene-methacrylate copolymer was 10 g or less. The resultant composition solution was coated on a 50-μm polyethylene-terephthalate film by a bar-coating method and dried, thereby forming a recording medium film with a film thickness of 5 μm. Subsequently, a 3.5-μm thick ethylene-terephthalate film, on the upper surface of which a 0.1-μm thick silicone-based lubricating layer was coated, and on the lower surface of which a 0.1-μm thick styrene-methacrylate copolymer was coated, was adhered to the recording medium by using a dry laminate method such that the lower surface of the protective film was in contact with the dispersion. Subsequently, the entire surface of the recording medium was pressed by a heated roll, and the medium was cooled to room temperature. Consequently, a colorless, transparent decolored state was obtained. Thermal printing was then performed with an applied voltage of 25 V and a pulse width of 150 μsec by using a thermal head (8 dot/mm, 1,000 Ω). As a result, the printed portion turned blue to indicate that recording was done. Additionally, thermal erasure was performed for the blue-colored portion by using the thermal head (8 dot/mm, 1,000 Ω) with an applied voltage of 25 V and a pulse width of 250 μsec. Consequently, it was confirmed that the colored portion returned to the colorless, transparent decolored state. Note that between the printed portion and the background, the contrast ratio of the transmittance with respect to light having a wavelength of 610 nm was 40.

What is claimed is:

1. A thermal recording medium in which information recording and erasing are performed on a basis of a crystalline-to-amorphous transition, comprising:

a color former; and a developer consisting of a compound having asteroid skeleton.

2. The thermal recording medium according to claim 1, wherein said developer has a glass transition temperature of 25° C. or more.

3. A recording method to a thermal recording medium according to claim 1, wherein information recording and erasing are performed by supplying thermal energies with two different values to heat the composition system constituting said thermal recording medium, (a) to a temperature equal to or higher than the crystallization temperature and lower than the melting point, and (b) to a temperature equal to or higher than the melting point.

4. A recording method to a thermal recording medium according to claim 1, wherein information recording and erasing are performed by providing two different heat histories after heating the composition system constituting said thermal recording medium to a temperature equal to or higher than the melting point of the composition system.

5. The thermal recording medium according to claim 1, wherein said developer can form a plurality of crystal forms.

6. The thermal recording medium according to claim 1, wherein said color former has a glass transition temperature of 25° C. or more.

7. A thermal recording medium comprising:

a color former;

a developer; and a reversible material consisting of a compound having a steroid skeleton which can effect a reversible crystalline-to-amorphous transition or reversible change between two phase separated states or between phase separated state and non-phase separated state in at least a part of a composition system where thermal energies with two different values are supplied or where two different heat histories are provided.

8. The thermal recording medium according to claim 7, wherein said reversible material can form a plurality of crystal forms.

9. The thermal recording medium according to claim 7, wherein said reversible material has a glass transition temperature of 25° C. or more.

10. The thermal recording medium according to claim 7, wherein said developer has a glass transition temperature of 25° C. or more.

11. The thermal recording medium according to claim 7, wherein said reversible material can reversibly repeat crystalline-to-amorphous transitions where thermal energies with two different values are supplied or where two different heat histories are provided.

12. The thermal recording medium according to claim 7, wherein said reversible material and said color former or said developer can reversibly repeat crystalline-to-amorphous transitions where thermal energies with two different values are supplied or where two different heat histories are provided.

13. The thermal recording medium according to claim 7, wherein said reversible material contains a plurality of compounds, and can reversibly repeat changes between two phase separated states or between phase separated state and non-phase separated state where thermal energies with two different values are supplied or where two different heat histories are provided.

14. The thermal recording medium according to claim 7, wherein said reversible material and said color former or said developer can reversibly repeat changes between two phase separated states or between phase separated state and non-phase separated state where thermal energies with two different values are supplied or where two different heat histories are provided.

15. The thermal recording medium according to claim 7, wherein said color-former, said developer and said reversible material are carried by a polymer compound.

16. The thermal recording medium according to claim 15, wherein a solubility of each of said color former, said developer and said reversible material to 100 g of said polymer compound is 10 g or less.

17. The thermal recording medium according to claim 15, wherein a ratio of repeating units constituted by elements selected from the group consisting of carbon, hydrogen and halogen in said polymer compound is larger than 75 wt %.

18. The thermal recording medium according to claim 15, wherein said polymer compound has polar substituents.

19. A recording method to a thermal recording medium according to claim 7, wherein information recording and erasing are performed by supplying thermal energies with two different values to heat the composition system constituting said thermal recording medium, (a) to a temperature equal to or higher than the crystallization temperature and lower than the melting point, and (b) to a temperature equal to or higher than the melting point.

20. A recording method to a thermal recording medium according to claim 7, wherein information recording and erasing are performed by providing two different heat histories after heating the composition system constituting said thermal recording medium to a temperature equal to or higher than the melting point of the composition system.

21. A thermal recording medium, comprising:

a color former;

a developer;

a reversible material consisting of a compound having a steroid skeleton which can effect a reversible crystalline-to-amorphous transition or reversible change between two phase separated states or between phase separated state and non-phase separated state in at least a part of a composition system where thermal energies with two different values are supplied or where two different heat histories are provided; and a phase separation controller which serves to change a phase separation rate between said color former or said developer and said reversible material in the vicinity of its melting point.

22. The thermal recording medium according to claim 21, wherein said phase separation controller serves to accelerate phase separation rate between said color former or said developer and said reversible material in the vicinity of its melting point.

23. The thermal recording medium according to claim 21, wherein said phase separation controller has a lower melting point than that of the three-component system consisting of said color former, said developer and said reversible material.

24. The thermal recording medium according to claim 21, wherein said phase separation controller is a low-molecular weight compound having a long-chain alkyl group and a polar substituent group.

25. The thermal recording medium according to claim 21, wherein said color former, said developer, said reversible material and said phase separation controller are carried by a polymer compound.

26. A recording method to a thermal recording medium according to claim 21, wherein information recording and erasing are performed by supplying thermal energies with two different values to heat the composition system constituting said thermal recording medium, (a) to a temperature equal to or higher than the melting point of said phase separation controller and lower than the melting point of the composition system, and (b) to a temperature equal to or higher than the melting point of the composition system.

27. A recording method to a thermal recording medium according to claim 21, wherein information recording and erasing are performed by providing two different heat histories after heating the composition system constituting said thermal recording medium to a temperature equal to or higher than the melting point of the composition system.

* * * * *